US009562717B2

(12) United States Patent
Kim et al.

(10) Patent No.: US 9,562,717 B2
(45) Date of Patent: Feb. 7, 2017

(54) REFRIGERATION PROCESS

(75) Inventors: Jin-Kuk Kim, Seoul (KR); Xuesong Zheng, Manchester (GB)

(73) Assignee: The University of Manchester, Manchester (GB)

( * ) Notice: Subject to any disclaimer, the term of this patent is extended or adjusted under 35 U.S.C. 154(b) by 705 days.

(21) Appl. No.: 13/636,866

(22) PCT Filed: Mar. 25, 2011

(86) PCT No.: PCT/GB2011/050617
§ 371 (c)(1),
(2), (4) Date: Sep. 24, 2012

(87) PCT Pub. No.: WO2011/117655
PCT Pub. Date: Sep. 29, 2011

(65) Prior Publication Data

US 2013/0008204 A1 Jan. 10, 2013

(30) Foreign Application Priority Data

Mar. 25, 2010 (GB) ..... 1005016.9
Mar. 7, 2011 (WO) ..... PCT/GB2011/050444

(51) Int. Cl.
*F25J 1/00* (2006.01)
*F25J 1/02* (2006.01)

(52) U.S. Cl.
CPC ..... *F25J 1/0022* (2013.01); *F25J 1/0012* (2013.01); *F25J 1/0015* (2013.01); *F25J 1/0017* (2013.01);
(Continued)

(58) Field of Classification Search
CPC ..... F25J 1/0012; F25J 1/0017; F25J 1/0022; F25J 1/0027; F25J 1/0212; F25J 1/0214; F25J 1/0245; F25J 1/0249; F25J 1/0052; F25J 1/0055; F25J 1/0057; F25J 2270/12; F25J 2270/14; F25J 2270/16; F25J 2270/66
(Continued)

(56) References Cited

U.S. PATENT DOCUMENTS 3,747,359 A 7/1973 Streich
3,929,438 A 12/1975 Harper et al.
(Continued)

FOREIGN PATENT DOCUMENTS

CN 101008545 A 8/2007
DE 19612173 C1 5/1997
(Continued)

OTHER PUBLICATIONS

Bronfenbrenner et al. LNG industry on a smaller scale—coil wound heat exchangers mid sized LNG plants: Liquefaction heat exchanger process requirements. LNG Industry (2008). 5 pages.
(Continued)

*Primary Examiner* — Keith Raymond
(74) *Attorney, Agent, or Firm* — Nixon Peabody LLP; Linda B. Huber

(57) ABSTRACT

The present invention relates to a single cycle mixed refrigerant process for industrial cooling applications, for example, the liquefaction of natural gas. The present invention also relates to a refrigeration assembly configured to implement the processes defined herein and a mixed refrigerant composition usable in such processes.

13 Claims, 11 Drawing Sheets

(52) U.S. Cl.
CPC ..... *F25J 1/0027* (2013.01); *F25J 1/0052* (2013.01); *F25J 1/0055* (2013.01); *F25J 1/0057* (2013.01); *F25J 1/0092* (2013.01); *F25J 1/0212* (2013.01); *F25J 1/0214* (2013.01); *F25J 1/0245* (2013.01); *F25J 1/0249* (2013.01); *F25J 1/0252* (2013.01); *F25J 1/0278* (2013.01); *F25J 2220/64* (2013.01); *F25J 2245/02* (2013.01); *F25J 2270/12* (2013.01); *F25J 2270/14* (2013.01); *F25J 2270/16* (2013.01); *F25J 2270/66* (2013.01)

(58) Field of Classification Search
USPC ..... 62/606, 611, 614, 615, 616
See application file for complete search history.

(56) References Cited

U.S. PATENT DOCUMENTS

| | | | | |
|---|---|---|---|---|
| 4,112,700 | A | 9/1978 | Forg | |
| 4,539,028 | A | 9/1985 | Paradowski et al. | |
| 4,846,862 | A * | 7/1989 | Cook | 62/48.2 |
| 4,901,533 | A | 2/1990 | Fan et al. | |
| 6,182,469 | B1 | 2/2001 | Campbell et al. | |
| 6,347,532 | B1 * | 2/2002 | Agrawal et al. | 62/612 |
| 6,427,483 | B1 | 8/2002 | Rashad et al. | |
| 6,658,891 | B2 | 12/2003 | Reijnen et al. | |
| 6,725,688 | B2 | 4/2004 | Elion et al. | |
| 2005/0198998 | A1 * | 9/2005 | Lee et al. | 62/612 |
| 2007/0078880 | A1 | 4/2007 | Eiron et al. | |
| 2008/0006053 | A1 | 1/2008 | Bauer et al. | |
| 2009/0205366 | A1 * | 8/2009 | Schmidt | 62/612 |

FOREIGN PATENT DOCUMENTS

| | | | |
|---|---|---|---|
| DE | 10209799 | A1 | 9/2003 |
| EA | 004468 | B1 | 4/2004 |
| EP | 1790926 | A1 | 5/2007 |
| ES | 2234496 | | 7/2005 |
| FR | 2280042 | A1 | 2/1976 |
| GB | 1344198 | A | 1/1974 |
| GB | 2326465 | A | 12/1998 |
| JP | 8159652 | | 6/1996 |
| RU | 2352877 | C2 | 4/2009 |
| WO | 0140725 | A1 | 6/2001 |

OTHER PUBLICATIONS

EA Application No. 201290951 Search Report dated Apr. 12, 2013; 1 page.
PCT/GB2011/050617 International Search Report and Written Opinion dated Jan. 28, 2014; 17 pages.
UK Application No. GB1005016.9 Search Report dated Jul. 13, 2010; 1 page.

* cited by examiner (a) Operating conditions
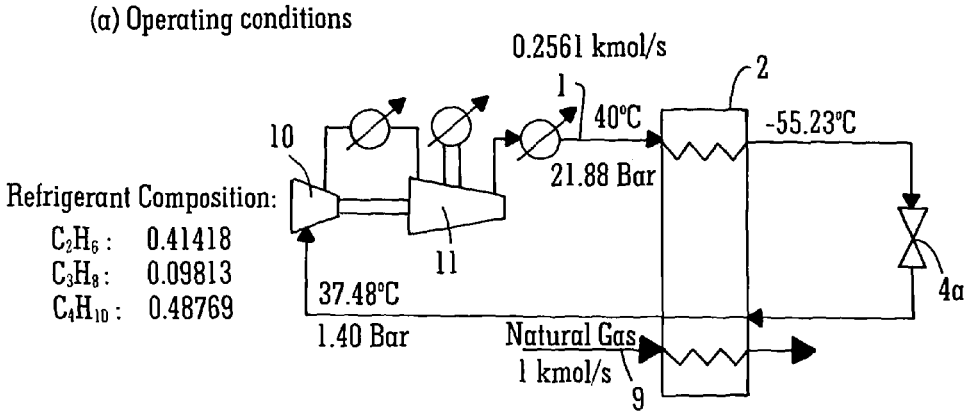
FIG. 6
(b) Composite curves and stream T-H profiles
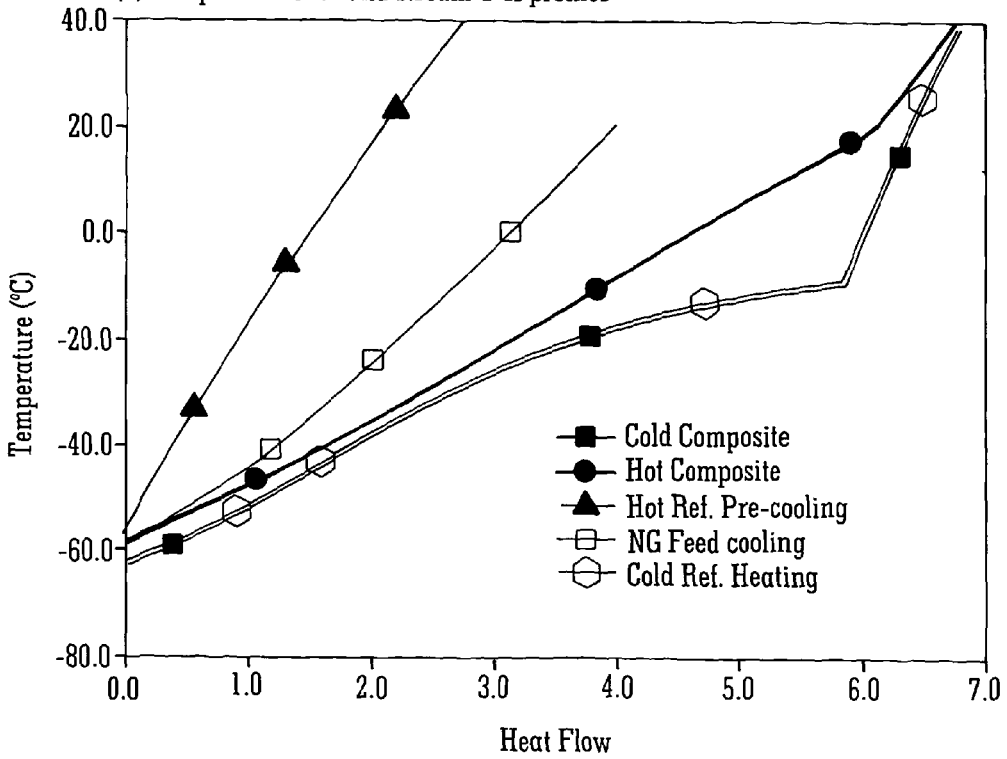

(a) Operating conditions
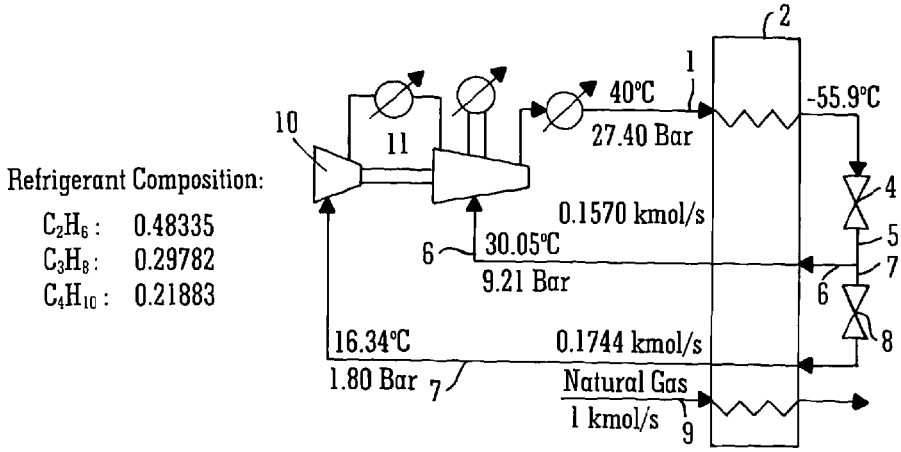
FIG. 7
(b) Composite curves
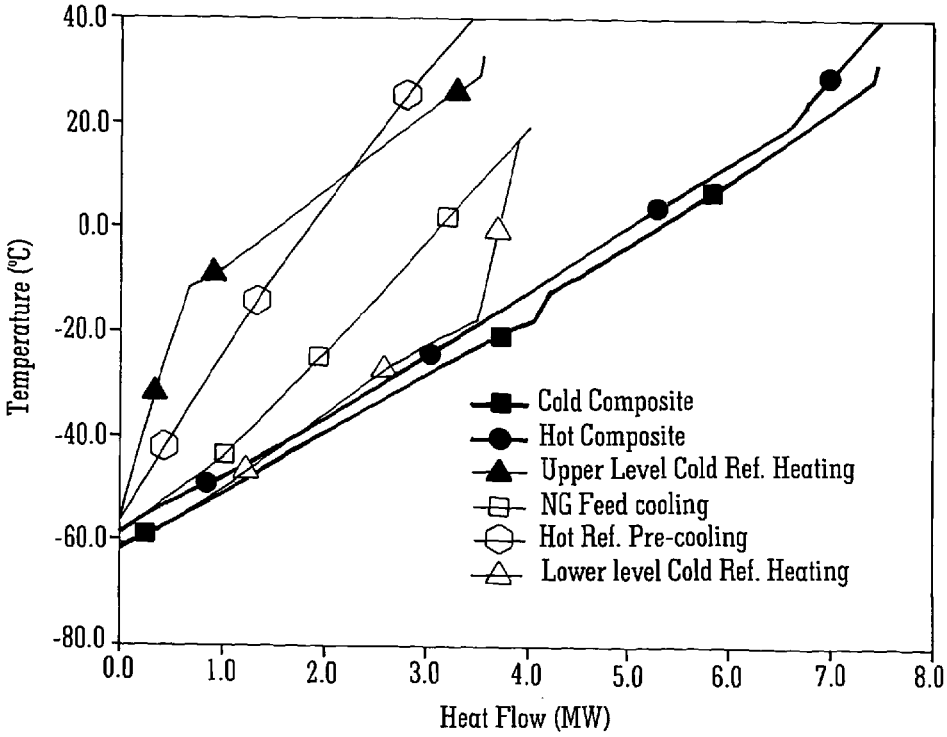

(a) Operating conditions
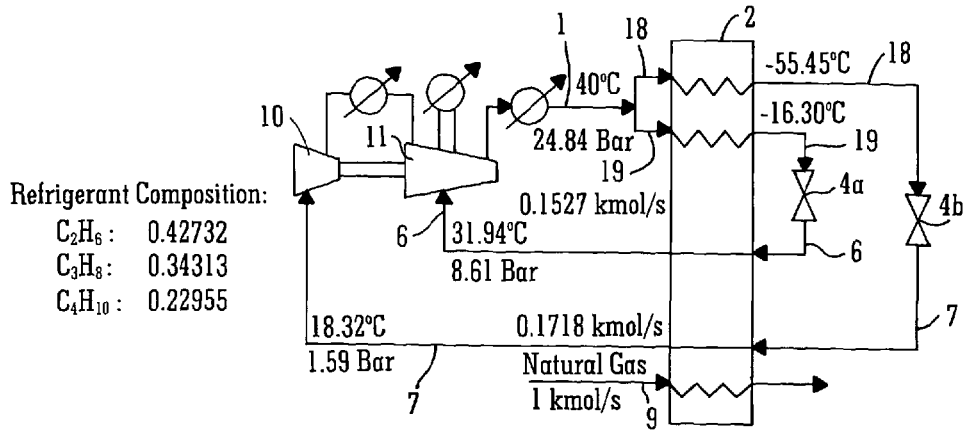
FIG. 8
(b) Composite curves
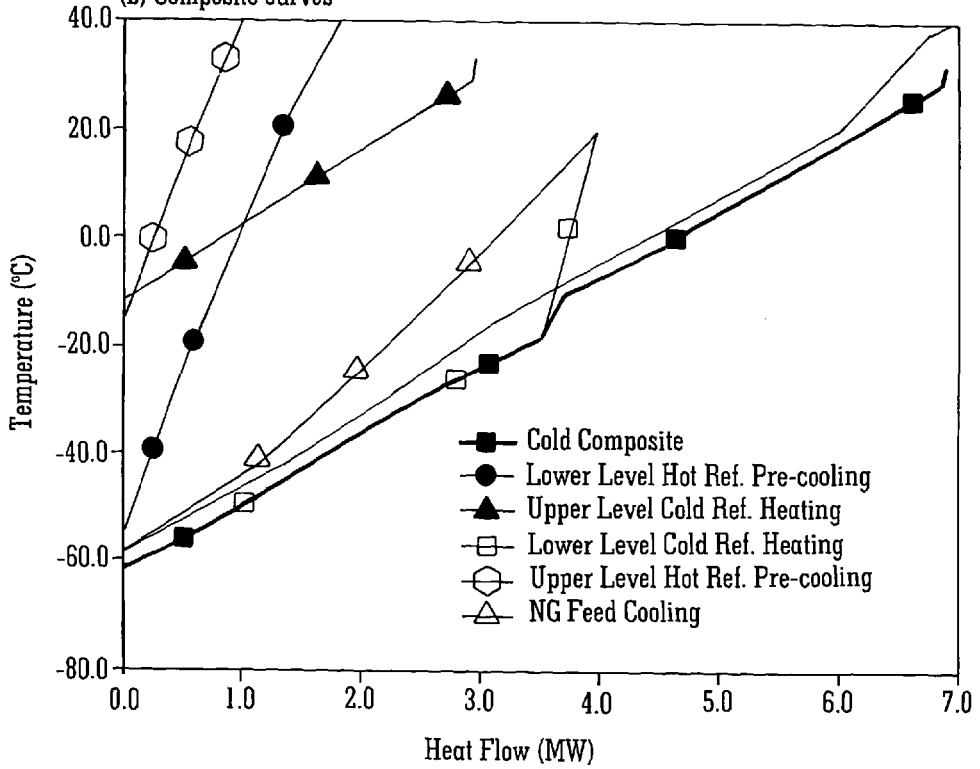

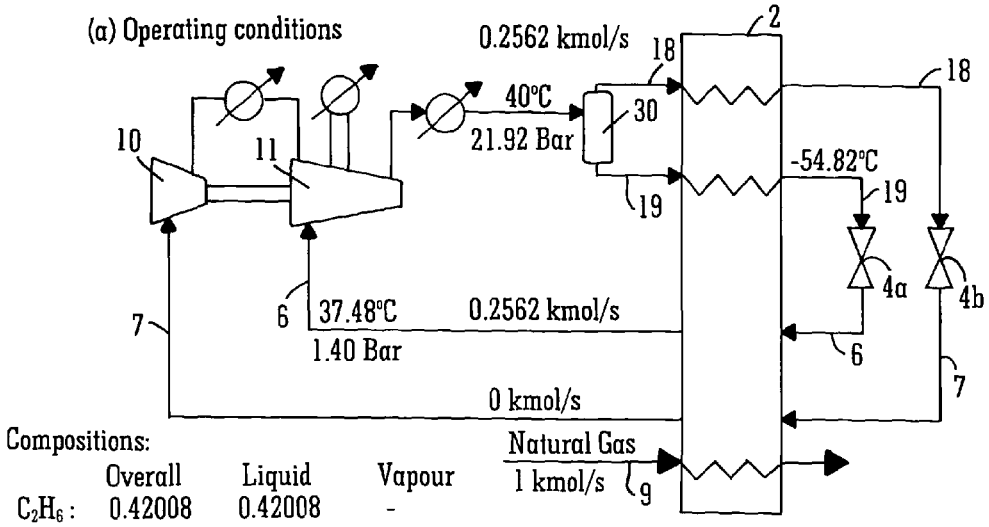
Compositions:
| | Overall | Liquid | Vapour |
|---|---|---|---|
| $C_2H_6$: | 0.42008 | 0.42008 | - |
| $C_3H_8$: | 0.08675 | 0.08675 | - |
| $C_4H_{10}$: | 0.49318 | 0.49318 | - |
FIG. 9
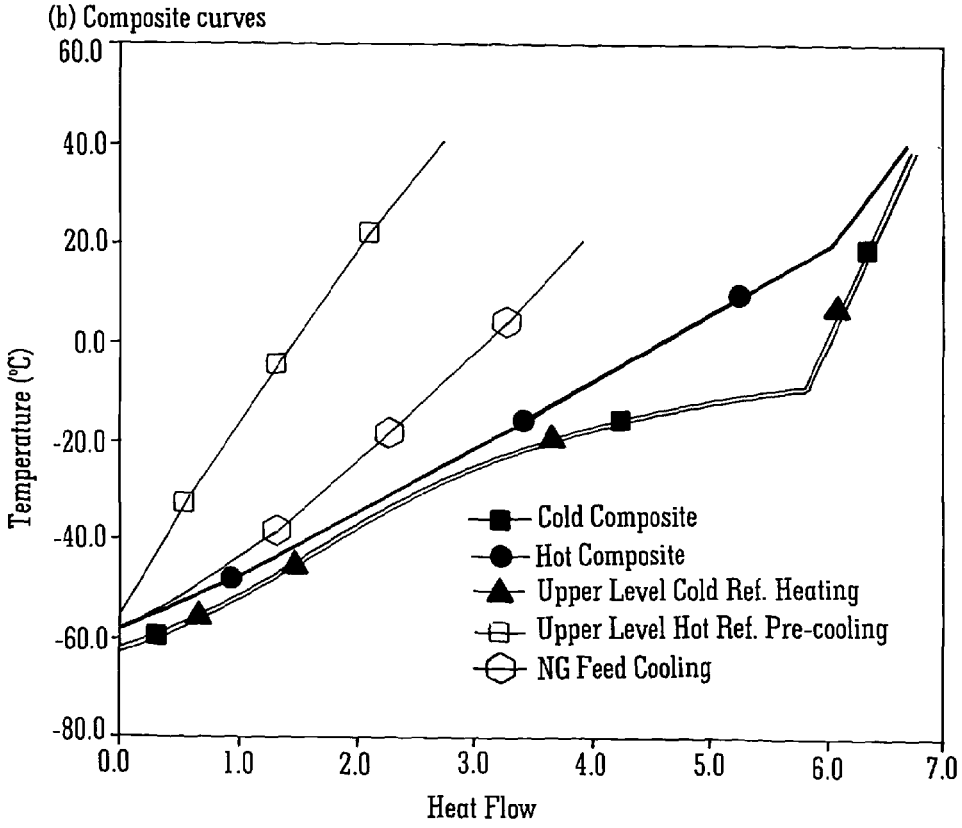

(a) Operating conditions
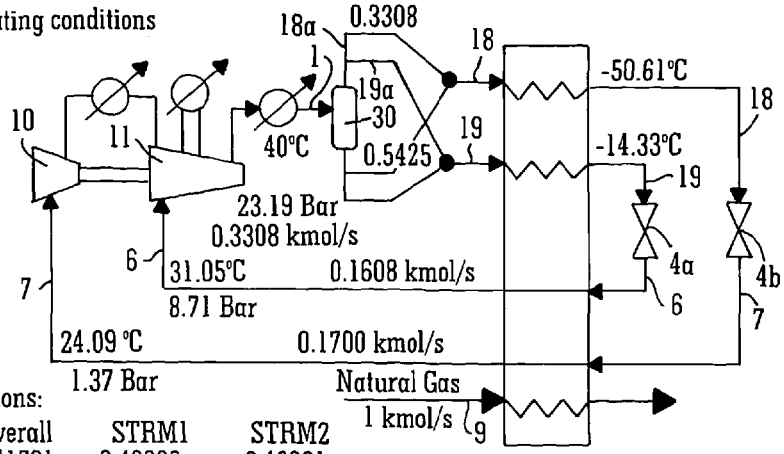
Compositions:
| | Overall | STRM1 | STRM2 |
|---|---|---|---|
| $C_2H_6$: | 0.41701 | 0.43266 | 0.40221 |
| $C_3H_8$: | 0.31934 | 0.31431 | 0.32409 |
| $C_4H_{10}$: | 0.28365 | 0.25304 | 0.27370 |
FIG. 10
(b) Composite curves
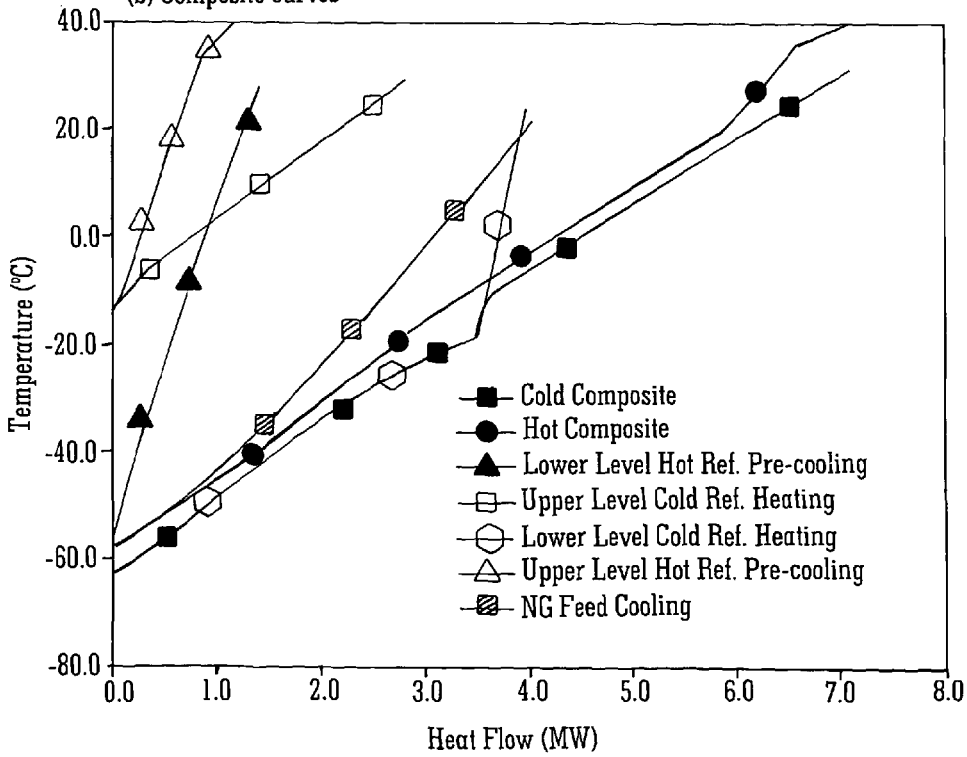

REFRIGERATION PROCESS

CROSS-REFERENCE TO RELATED APPLICATIONS

This application is the National Phase of International Application PCT/GB2011/050617, filed Mar. 25, 2011, which designated the United States and that International Application was published under PCT Article 21(2) in English. This application also includes a claim of priority under 35 U.S.C. §119(a) and §365(b) to PCT/GB2011/050444 filed Mar. 7, 2011 and British patent application No. 1005016.9 filed Mar. 25, 2010.

This invention relates to a refrigeration process and, more particularly but not exclusively, to a refrigeration process that is suitable for the liquefaction of natural gas.

BACKGROUND

The delivery of natural gas from the site of extraction to the end consumer presents a significant logistical challenge. Pipelines can be used to transport natural gas over short distances (typically less than 2000 km in offshore environments and less than 3800 km in onshore environments), but they are not an economical means of transport when larger distances are involved. Furthermore, it is not practical to build pipelines in certain environments, such as, for example, across large expanses of water.

It is more economical to transport liquefied natural gas (LNG) over very large distances and in situations where delivery to a number of different destinations is required. The first stage in the liquefied natural gas delivery chain involves the production of the natural gas. The natural gas is then transferred to a LNG production plant where it is liquefied prior to transportation (typically by shipping). The liquid natural gas is then re-vaporised at the destination and distributed to the end consumers by pipeline delivery.

The liquefaction of natural gas is achieved by exposing a natural gas feed stream to one or more refrigeration cycles. These refrigeration cycles can be extremely energy intensive, primarily due to the amount of shaft power input required to run the refrigerant compressors.

A number of refrigeration processes for liquefying natural gas are known in the art. One well established approach involves the cooling and condensing a natural gas feed gas stream in one or more heat exchangers against multiple refrigerant streams provided by re-circulating refrigeration systems. Cooling of the natural gas feed is accomplished by various cooling process cycles, such as the well known cascade cycle in which refrigeration is provided by three different refrigerant loops. One such cascade cycle uses methane, ethylene and propane cycles in sequence to produce refrigeration at three different temperature levels. Another well-known refrigeration cycle uses a propane pre-cooled, mixed refrigerant cycle in which a multi-component refrigerant mixture generates refrigeration over a selected temperature range. The mixed refrigerant can contain hydrocarbons such as methane, ethane, propane and other light hydrocarbons, and also may contain nitrogen. Versions of this refrigeration system are used in many operating LNG plants around the world.

One of the simplest refrigeration systems comprises a single mixed refrigerant cycle (e.g. the Black & Veatch PRICO process). One problem with such processes is that they exhibit lower thermodynamic efficiency relative to more complex processes (e.g. the propane-cooled mixed refrigerant cycle by Air products, or the double mixed refrigerant cycle by Shell). Furthermore, the thermodynamic performance and efficiency of a single mixed refrigerant cycle can only be varied by adjusting a small number of operating variables, such as the refrigerant composition, the condensation and evaporation temperature and the pressure level. The more complex multi-cycle processes are able to offer improved cycle efficiency by providing more operating variables, including, for example, varying the composition and temperature of multiple refrigerant streams, which can significantly affect the exergy loss in heat exchangers. By properly adjusting these additional operating variables, the thermodynamic efficiency can be significantly improved in these more complicated refrigeration processes when compared with a single mixed refrigerant cycle. However, multi-stage or cascade refrigeration processes usually require much more complicated equipment configurations, and this results in significant plant and equipment costs.

Consequently, there is a balance to be struck between providing a refrigeration process that is simple in design and construction, and thereby saves on plant and equipment costs, and providing a process which also possesses sufficient operating variables to enable satisfactory and/or improved operating efficiency.

The present invention seeks to provide refrigeration processes that address one or more of the aforementioned drawbacks by providing a single cycle, mixed refrigeration process which comprises additional operating variables to enable the provision of improved operating efficiency.

BRIEF SUMMARY OF THE DISCLOSURE

In accordance with a first aspect of the present invention there is provided a refrigeration process for cooling a product feed stream, the process comprising passing the product feed stream through a heat exchanger comprising a first refrigerant stream of mixed refrigerant and a second refrigerant stream of mixed refrigerant; wherein the first refrigerant stream is configured to evaporate at temperature which is lower than that of the second refrigerant stream; and wherein the first refrigerant stream, upon exiting the heat exchanger, is subject to an initial compression prior to mixing with the second refrigerant feed stream from the heat exchanger to form a single refrigerant stream which is subjected to a second compression to form a compressed refrigerant stream, and wherein:

(i) the refrigerant in the compressed refrigerant stream is then subject to cooling in the heat exchanger followed by expansion prior to being reintroduced into the heat exchanger to cool the feed stream; and (ii) the compressed refrigerant stream is split into two streams that form the first and second refrigerant streams that feed into the heat exchanger either prior to, during or after said cooling of the compressed refrigerant in the heat exchanger.

The process of the present invention provides a novel mixed refrigerant cycle which provides a balance between thermodynamic efficiency and process complexity, thereby providing a cost effective alternative to the current liquefaction processes. Essentially, the process of the first aspect of the present invention provides the simplicity of a single mixed refrigerant cycle and a single heat exchanger, but provides more operating variables (or "degrees of freedom") to enable the thermodynamic efficiency of the process to be enhanced.

In particular, the provision of first and second refrigerant streams of different temperature, pressure and/or composition (as provided in some embodiments of the present invention) in a single cycle mixed refrigerant process provides additional flexibility to enable the thermodynamic efficiency to be optimised. More specifically, this flexibility enables the temperature-enthalpy profile of the refrigerant to be matched to the cooling profile of the feed gas stream as closely as possible.

Furthermore, the provision of at least two compression steps (namely an initial compression which is only applied to the first refrigerant stream (the lowest pressure stream) exiting the heat exchanger, followed by a second compression applied to the mixture of the compressed first refrigerant stream and the refrigerant of the second refrigerant stream exiting the heat exchanger) enables the compression process to be made more efficient than would be the case if all of the refrigerant exiting the heat exchanger is compressed together.

In a second aspect, the present invention provides a refrigeration process for cooling a product feed stream, the process comprising passing the product feed stream through a heat exchanger comprising a first refrigerant stream of mixed refrigerant and a second refrigerant stream of mixed refrigerant; wherein the first refrigerant stream is configured to evaporate at temperature which is lower than that of the second refrigerant stream;

and wherein the first refrigerant stream, upon exiting the heat exchanger, is subject to an initial compression prior to mixing with the second refrigerant feed stream from the heat exchanger to form a single refrigerant stream which is subjected to a second compression to form a compressed refrigerant stream, and wherein:

(i) the refrigerant in the compressed refrigerant stream is then subject to cooling in the heat exchanger followed by expansion prior to being reintroduced into the heat exchanger to cool the feed stream; and (ii) the compressed refrigerant stream is split into separate streams that form the first and second refrigerant streams prior to or during said cooling of the compressed refrigerant in the heat exchanger.

The process of the second aspect of the present invention provides a further novel mixed refrigerant cycle which provides a balance between thermodynamic efficiency and process complexity, thereby providing a cost effective alternative to the current liquefaction processes. Essentially, the process of the second aspect of the present invention also provides the simplicity of a single mixed refrigerant cycle, but provides more operating variables (or "degrees of freedom") to enable the thermodynamic efficiency of the process to be enhanced.

The process of the second aspect of the invention may comprise a single heat exchanger or one or more heat exchangers arranged in series. Suitably, to keep costs to a minimum, the number of heat exchangers will be limited to between one and three. In an embodiment, one or two heat exchangers may be present. In a particular embodiment, just one single heat exchanger is utilised.

In an embodiment, the compressed refrigerant stream is split into separate streams that form the first and second refrigerant streams prior to the cooling of the compressed refrigerant. In a particular embodiment, the refrigerant streams are split in a flash unit prior to cooling in the heat exchanger. This provides separate streams with different compositions.

As for the process of the first aspect of the invention, the provision of first and second refrigerant streams of different temperature, pressure and/or composition (as provided in some embodiments of the present invention) in a single cycle mixed refrigerant process provides additional flexibility to enable the thermodynamic efficiency to be optimised. More specifically, this flexibility enables the temperature-enthalpy profile of the refrigerant to be matched to the cooling profile of the feed gas stream as closely as possible.

Furthermore, the provision of at least two compression steps (namely an initial compression which is only applied to the first refrigerant stream (the lowest pressure stream) exiting the heat exchanger, followed by a second compression applied to the mixture of the compressed first refrigerant stream and the refrigerant of the second refrigerant stream exiting the heat exchanger) again enables the compression process to be made more efficient than it would be if all of the refrigerant exiting the heat exchanger is compressed together.

In a particular aspect, the present invention provides a natural gas liquefaction process as defined herein.

In a further aspect the present invention provides a refrigeration assembly as defined herein which is configured to implement a process as defined herein.

In a particular aspect, the present invention provides a refrigeration assembly/apparatus comprising a single heat exchanger adapted to receive a product stream to be cooled during use and a refrigerant cycle, said assembly/apparatus comprising:

a first and a second refrigerant stream flowing through the heat exchanger to provide cooling; wherein the refrigerant in the first refrigerant stream is configured to evaporate at temperature which is lower than that of the refrigerant in the second refrigerant stream;

a first compression means adapted to receive the first refrigerant stream exiting the heat exchanger and compress the refrigerant to a first level of compression;

a second compression means adapted to receive a mixture of the second refrigerant stream exiting the heat exchanger and the compressed refrigerant stream from the first compression means and compress the mixture to form a compressed refrigerant stream;

means for directing the refrigerant in the compressed refrigerant stream into the heat exchanger to be cooled;

means for delivering the cooled refrigerant to an expansion means and then delivering the expanded refrigerant into the heat exchanger; and means for splitting the compressed refrigerant stream into two separate refrigerant streams that form the first and second refrigerant streams that feed into the heat exchanger and wherein said splitting of the compressed refrigerant stream occurs either prior to, during or after said cooling of the compressed refrigerant in the heat exchanger.

In a further aspect, the present invention provides a refrigeration assembly/apparatus comprising one or more heat exchangers adapted to receive a product stream to be cooled during use and a refrigerant cycle, said assembly/apparatus comprising:

a first and a second refrigerant stream flowing through the heat exchanger(s) to provide cooling; wherein the refrigerant in the first refrigerant stream is configured to evaporate at temperature which is lower than that of the refrigerant in the second refrigerant stream;

a first compression means adapted to receive the first refrigerant stream exiting the heat exchanger(s) and compress the refrigerant to a first level of compression;

a second compression means adapted to receive a mixture of the second refrigerant stream exiting the heat exchanger(s) and the compressed refrigerant stream from the first compression means and compress the mixture to form a compressed refrigerant stream;

means for directing the refrigerant in the compressed refrigerant stream into the heat exchanger(s) to be cooled;

means for delivering the cooled refrigerant to an expansion means and then delivering the expanded refrigerant into the heat exchanger(s); and means for splitting the compressed refrigerant stream into two separate refrigerant streams that form the first and second refrigerant streams that feed into the heat exchanger and wherein said splitting of the compressed refrigerant stream occurs either prior to or during or after said cooling of the compressed refrigerant in the heat exchanger.

In a further aspect, the present invention provides a refrigerant composition comprising:

methane 15-25 mol %,
ethane 30-45 mol %
propane 0-20 mol %
n-butane 0-25 mol %
and nitrogen 5-20 mol %.

BRIEF DESCRIPTION OF THE DRAWINGS

Embodiments of the invention are further described hereinafter with reference to the accompanying drawings, in which:

FIG. 6(*a*) is a schematic diagram showing the optimised operating conditions for a single mixed refrigerant (MR) process and FIG. 6(*b*) shows the composite curves and temperature-enthalpy profiles for this process;

FIG. 7(*a*) is a schematic diagram showing the optimised operating conditions for the first embodiment of the present invention shown in FIG. 1 and FIG. 7(*b*) shows the composite curves and temperature-enthalpy profiles for this embodiment;

FIG. 8(*a*) is a schematic diagram showing the optimised operating conditions for a second embodiment of the present invention (FIG. 2) and FIG. 8(*b*) shows the composite curves and temperature-enthalpy profiles for this embodiment;

FIG. 9(*a*) is a schematic diagram showing the optimised operating conditions for a third embodiment of the present invention (FIG. 3) and FIG. 9(*b*) shows the composite curves and temperature-enthalpy profiles for this embodiment;

FIG. 10(*a*) is a schematic diagram showing the optimised operating conditions for a fourth embodiment of the present invention (FIG. 4) and FIG. 10(*b*) shows the composite curves and temperature-enthalpy profiles for this embodiment.

DETAILED DESCRIPTION

Figure 1:
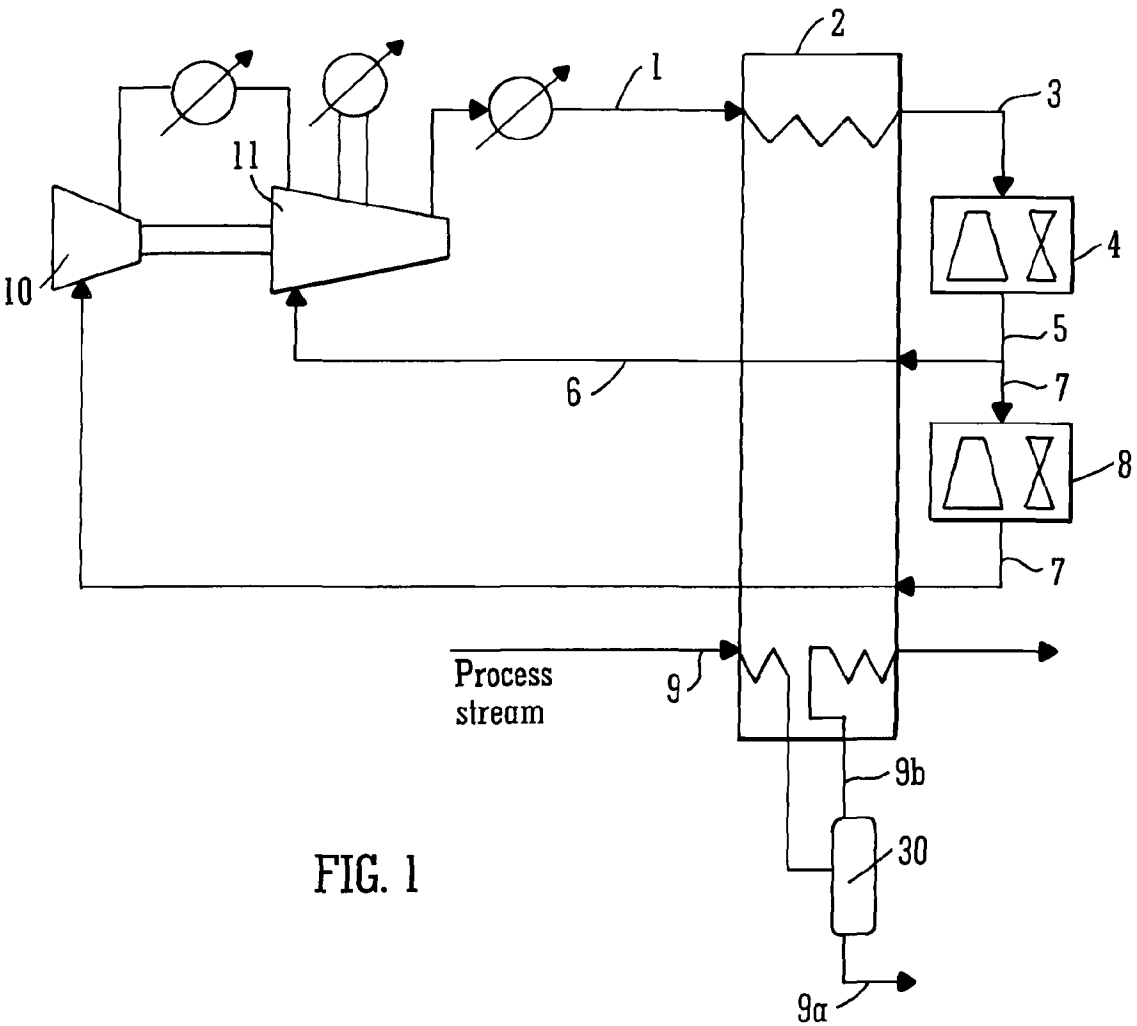
FIG. 1 is a schematic diagram showing a first embodiment of the present invention.

The terms "mixed refrigerant" and "MR" are used interchangeably herein and mean a mixture that contains two or more refrigerant components.

The term "refrigerant component" means a substance used for heat transfer which absorbs heat at a lower temperature and pressure and rejects heat at a higher temperature and pressure. For example, a "refrigerant component," in a compression refrigeration system, will absorb heat at a lower temperature and pressure through evaporation and will reject heat at a higher temperature and pressure through condensation. Illustrative refrigerant components may include, but are not limited to, alkanes, alkenes, and alkynes having one to five carbon atoms, nitrogen, chlorinated hydrocarbons, fluorinated hydrocarbons, other halogenated hydrocarbons, and mixtures or combinations thereof.

The term "natural gas" is well known in the art. Natural gas is typically a light hydrocarbon gas or a mixture of two or more light hydrocarbon gases. Illustrative light hydrocarbon gases may include, but are not limited to, methane, ethane, propane, butane, pentane, hexane, isomers thereof, unsaturates thereof, and mixtures thereof. The term "natural gas" may further include some level of impurities, such as nitrogen, hydrogen sulfide, carbon dioxide, carbonyl sulfide, mercaptans and water. The exact percentage composition of the natural gas varies depending upon the reservoir source and any pre-processing steps used as part of the extraction process, such as amine extraction or desiccation via molecular sieves, for example.

The terms "gas" and "vapour" are used interchangeably and mean a substance or mixture of substances in the gaseous state as distinguished from the liquid or solid state.

The term "heat exchanger" means any one type or combination of similar or different types of equipment known in the art for facilitating heat transfer. For example, a "heat exchanger" may be contained or at least partially contained within one or more spiral wound type exchanger, plate-fin type exchanger, shell and tube type exchanger, or any other type of heat exchanger known in the art that is capable of withstanding the process conditions described herein in more detail below. Heat exchangers are also commonly referred to in the art as "cold boxes".

The terms "compressor" or "compression means" are used herein to refer to any one particular type or combination of similar or different types of compression equipment, and may include auxiliary equipment, known in the art for compressing a substance or mixture of substances. A "compressor" or "compression means" may utilise one or more compression stages. Illustrative compressors may include, but are not limited to, positive displacement types, such as reciprocating and rotary compressors for example, and dynamic types, such as centrifugal and axial flow compressors, for example. Illustrative auxiliary equipment may include, but are not limited to, suction knock-out vessels, discharge coolers or chillers, inter-stage coolers, recycle coolers or chillers, and any combination thereof.

The term "expansion" is used herein to refer to the expansion of the refrigerant stream, which causes a consequential decrease in pressure. The expansion of the refrigerant stream is facilitated by using any suitable expansion means known in the art. For example, the "expansion means" may be an expansion valve or an expander or an expansion chamber.

Most liquid natural gas plants in use today provide cooling by compressing a refrigerant gas to a high pressure, liquefying the refrigerant gas with a cooling source, expanding the refrigerant liquid to a low pressure and drawing heat from the natural gas feed stream to vaporise the liquid refrigerant. The vaporised refrigerant is then recompressed and reused in the process. Thus, the net effect of this continuous cycle is the cooling and liquefaction of the natural gas feed stream. The process of the present invention makes use of this continuous refrigerant cycle with a number of modifications to improve the thermodynamic efficiency of the process without adding undue complexity to the process.

As previously stated, the present invention provides, in a first aspect, a refrigeration process for cooling a product feed stream, the process comprising passing the product feed stream through a heat exchanger comprising a first refrigerant stream of mixed refrigerant and a second refrigerant stream of mixed refrigerant; wherein the first refrigerant stream is configured to evaporate at temperature which is lower than that of the second refrigerant stream;

and wherein the first refrigerant stream, upon exiting the heat exchanger, is subject to an initial compression prior to mixing with the second refrigerant feed stream from the heat exchanger to form a single refrigerant stream which is subjected to a second compression to form a compressed refrigerant stream, and wherein:

(i) the refrigerant in the compressed refrigerant stream is then subject to cooling in the heat exchanger followed by expansion prior to being reintroduced into the heat exchanger; and (ii) the compressed refrigerant stream is split into two streams that form the first and second refrigerant streams that feed into the heat exchanger either prior to, during or after said cooling of the compressed refrigerant in the heat exchanger.

Thus, the process of the present invention provides a single cycle, mixed refrigerant process for the liquefaction of a gas feed stream. In particular, the process of the present invention is configured to provide a first and a second refrigerant stream to provide differential cooling effects to the gas feed stream. In some embodiments of the inventions, the process may further comprise additional (for example, 3, 4 or 5) refrigerant streams.

The first refrigerant stream can be configured to provide cooling at a temperature which is below that of the second refrigerant stream by varying, in certain embodiments, the temperature, pressure and/or composition of the first refrigerant relative to the second refrigerant stream. Suitably, the temperature and/or pressure of the first refrigerant stream is lower than the pressure and/or temperature of the second stream of mixed refrigerant. Alternatively or in addition, the composition of the first stream of mixed refrigerant may differ from that of the second stream of refrigerant such that the first refrigerant stream will evaporate and provide a cooling effect at a lower temperature than that of the second refrigerant stream.

In an embodiment of the invention, the first refrigerant stream is at a pressure and/or temperature that is lower than that of the second refrigeration stream.

In a further embodiment of the invention, the first refrigerant stream has a different composition to that of the second refrigeration stream and is optionally also at a temperature and/or pressure that is lower than that of the second refrigeration stream.

In an embodiment of the invention, the first refrigerant stream is at a pressure that is lower than that of the second refrigeration stream.

Suitably, the first refrigerant stream is at a low pressure and the second refrigerant stream is at an intermediate pressure.

The processes by which the temperature, pressure and/or composition of the first and second refrigeration streams can be varied are described further herein.

The temperature range within which the first and second refrigerant streams vaporise will be selected for the particular application concerned.

Upon exiting the heat exchanger, the first refrigerant stream is transferred to a compressor where it is subject to an initial compression prior to mixing with the second refrigerant stream flowing out from the heat exchanger. This initial compression suitably pressurises the first refrigerant stream to a pressure which is of a similar order to that of the second refrigerant feed stream. The two steams are then mixed and subject to a further compression to form a single (combined) compressed refrigerant stream.

The operational variability in the single cycle, mixed refrigerant process of the present invention arises in the subsequent processing of the compressed refrigerant stream to regenerate the first and second refrigerant feed streams that feed into the heat exchanger. In order to regenerate the first and second refrigerant streams that feed into the heat exchanger, the compressed refrigerant needs to be cooled (which is achieved by passing the refrigerant through the heat exchanger where it is cooled by the first and/or second refrigerant streams) and then expanded to reduce the pressure. In addition, the single stream needs to be split into separate streams that form the first and second refrigeration feed streams for the heat exchanger. The point at which this splitting occurs can be varied. In particular, the splitting into separate streams can take place prior to, during or after the cooling of the refrigerant stream in the heat exchanger.

In an embodiment, the single compressed refrigerant stream is split into separate feed streams (that ultimately form the first and second refrigerant feed streams) prior to the cooling of the compressed refrigerant in the heat exchanger. In such an arrangement, additional operational variability is provided by the ability to then cool the refrigerant in the individual streams to a different extent in the heat exchanger. Each refrigerant stream can then be expanded to form the desired first and second refrigerant feed streams for the heat exchanger with an optimal temperature and pressure.

In a further embodiment, the single compressed refrigerant stream is split into separate feed streams (that ultimately form the first and second refrigerant feed streams) after the refrigerant has been cooled in the heat exchanger. In such an arrangement, operational variability is provided by the ability to then expand the refrigerant in the individual streams to a different extent to form the desired pressure in the first and second refrigerant feed streams.

Suitably, the compressed refrigerant stream is either:

(i) cooled by the first and/or second refrigerant streams in the heat exchanger as a single stream prior to being split into first and second streams that are then independently subject to expansion to form the first and second refrigerant streams respectively that flow into the heat exchanger to provide the cooling effect;

(ii) cooled by the first and/or second refrigerant streams in the heat exchanger as a single stream prior to being subject to an initial expansion and then split into first and second streams, the first stream being subject to further expansion to form the first refrigeration stream and the second stream forming the second refrigerant stream; or (iii) split into two separate refrigerant streams, which are then cooled by the first and/or second refrigerant streams in the heat exchanger and subject to expansion independently to form the first and second refrigerant streams that flow into the heat exchanger to provide the cooling effect.

In a particular embodiment of the invention, the compressed refrigerant stream is initially cooled by the first and/or second refrigerant streams in the heat exchanger as a single refrigerant stream prior to being split into first and second streams that are then subject to expansion separately to form the first and second refrigerant streams respectively that flow into the heat exchanger to provide the cooling effect.

In another embodiment of the invention, the compressed refrigerant stream is initially cooled by the first and/or second refrigerant streams in the heat exchanger as a single stream prior to being subject to an initial expansion and then split into first and second streams, the first stream being subject to further expansion to form the first refrigeration stream and the second stream forming the second refrigerant stream.

In another embodiment of the invention, the compressed refrigerant stream is split into two separate refrigerant streams, which are then cooled by the first and/or second refrigerant streams in the heat exchanger and subject to expansion to form the first and second refrigerant streams that flow into the heat exchanger to provide the cooling effect.

The process of the present invention may further comprise the step of splitting the single compressed refrigerant stream in a flash unit. A "flash unit" is a unit that enables the single compressed mixed refrigerant to be separated into liquid and gaseous/vapour phases. Suitably the flash unit is positioned up stream from the heat exchanger so that the single compressed mixed refrigerant stream is separated in the flash unit prior to the subsequent cooling and then expansion of the refrigerant streams. The use of a flash unit provides further operational variability by enabling the composition of the separate feed streams to be varied. For example, it is possible to withdraw a gaseous/vapour phase and a liquid phase from the flash unit. The vapor and liquid phase refrigerant streams withdrawn from the flash unit may, in one embodiment, be cooled and then expanded to form the first and second refrigerant feed streams. It shall be appreciated that the vapor stream will need to be cooled to a sufficient extent to convert it into a liquid. In an alternative embodiment, the separate vapor and liquid refrigerant streams withdrawn from the flash unit may then be mixed together in certain proportions to form separate feed streams with different compositions. The use of a flash unit therefore enables to composition of the separate refrigerant streams to be varied by enabling the components of the compressed refrigerant stream to be at least partially separated based on their physical state within the flash unit. The ability to vary the composition of the refrigerant in the first and second refrigerant feed streams in this way provides additional operational variability and provides a further means for optimising the composition of the first and second refrigerant streams for the desired cooling application.

The composition, temperature and pressures of the two refrigerant feed streams can all be varied by various techniques described herein to optimise the thermodynamic efficiency of cycle for the particular gas feed stream concerned.

The first and second refrigerant streams provide cooling to the gas feed stream in the heat exchanger as well as pre-cooling to the compressed refrigerant as part of the refrigerant re-cycling.

It will be appreciated that the precise composition, temperature and pressure of the first and second feed streams can be optimised for the particular application concerned. For the liquefaction of natural gas, the pressure of the refrigerant stream prior to expansion will typically be 40 to 50 bar. Following expansion, the pressure of the refrigerant in first refrigerant stream will typically be within the range of 1.1 to 3 bar, and the pressure of the second refrigerant stream will typically be within the range of 5 to 15 bar.

Any suitable composition of mixed refrigerant may be used. It shall be appreciated that the mixed refrigerant composition can be adjusted depending on the product stream involved and the particular refrigeration scheme employed. In a particular embodiment, the refrigerant has the following composition:

methane 15-25 mol %,
ethane 30-45 mol %,
propane 0-20 mol %,
n-butane 0-25 mol %
and nitrogen 5-20 mol %.

The process of the first aspect of the present invention makes use of a single refrigerant cycle using a single heat exchanger. Alternatively, the process may comprise multiple refrigerant cycles in a single heat exchanger.

As previously indicated, the present invention also provides a refrigeration assembly/apparatus comprising a single heat exchanger adapted to receive a product stream to be cooled during use and a refrigerant cycle, said assembly/apparatus comprising:

a first and a second refrigerant stream flowing through the heat exchanger to provide cooling; wherein the refrigerant in the first refrigerant stream is configured to evaporate at temperature which is lower than that of the refrigerant in the second refrigerant stream;

a first compression means adapted to receive the first refrigerant stream exiting the heat exchanger and compress the refrigerant to a first level of compression;

a second compression means adapted to receive a mixture of the second refrigerant stream exiting the heat exchanger and the compressed refrigerant stream from the first compression means and compress the mixture to form a compressed refrigerant stream;

means for directing the refrigerant in the compressed refrigerant stream into the heat exchanger to be cooled;

means for delivering the cooled refrigerant to an expansion means and then delivering the expanded refrigerant into the heat exchanger; and means for splitting the compressed refrigerant stream into two separate refrigerant streams that form the first and second refrigerant streams that feed into the heat exchanger and wherein said splitting of the compressed refrigerant stream occurs either prior to, during or after said cooling of the compressed refrigerant in the heat exchanger.

Particular configurations of the refrigeration assemblies of the present invention will be apparent from the description of particular embodiments of the invention provided herein.

As stated above, in a second aspect, the present invention provides a refrigeration process for cooling a product feed stream, the process comprising passing the product feed stream through a heat exchanger comprising a first refrigerant stream of mixed refrigerant and a second refrigerant stream of mixed refrigerant; wherein the first refrigerant stream is configured to evaporate at temperature which is lower than that of the second refrigerant stream;

and wherein the first refrigerant stream, upon exiting the heat exchanger, is subject to an initial compression prior to mixing with the second refrigerant feed stream from the heat exchanger to form a single refrigerant stream which is subjected to a second compression to form a compressed refrigerant stream, and wherein:

(i) the refrigerant in the compressed refrigerant stream is then subject to cooling in the heat exchanger followed by expansion prior to being reintroduced into the heat exchanger to cool the feed stream; and (ii) the compressed refrigerant stream is split into separate streams that form the first and second refrigerant streams prior to or during said cooling of the compressed refrigerant in the heat exchanger.

The process of the second aspect of the present invention is the same as the process of the first aspect defined above, except that it requires the refrigerant stream to be split prior to or during cooling in the heat exchanger. Furthermore, it does not require the use of just a single heat exchanger. However, all the other features of the process of the second aspect of the invention (such as the product feed stream, the first and second refrigerant streams of mixed refrigerant, the initial compression of the first refrigerant stream prior to mixing with the second refrigerant feed stream from the heat exchanger to form a single refrigerant stream; the second compression of the combined refrigerant stream to form a compressed refrigerant stream, subjecting the refrigerant in the compressed refrigerant stream to cooling in the heat exchanger followed by expansion prior to being reintroduced into the heat exchanger to cool the feed stream) are all as defined above for the process of the first aspect of the invention.

The process of the second aspect of the invention may comprise a single heat exchanger or one or more heat exchangers arranged, for example, in series. Suitably, to keep costs to a minimum, there may be one to three heat exchangers present. In an embodiment, one or two heat exchangers are provided. In a preferred embodiment, just one single heat exchanger is present.

In an embodiment, the compressed refrigerant stream is split into separate streams that form the first and second refrigerant streams prior to the cooling of the compressed gas. In a particular embodiment, the refrigerant streams are split in a flash unit prior to cooling in the heat exchanger. This provides separate streams with different compositions.

The present invention further provides a refrigeration assembly comprising one or more heat exchangers adapted to receive a product stream to be cooled during use and a refrigerant cycle, said heat exchanger(s) comprising:

a first and a second refrigerant stream flowing through the heat exchanger(s) to provide cooling; wherein the refrigerant in the first refrigerant stream is configured to evaporate at temperature which is lower than that of the refrigerant in the second refrigerant stream;

a first compression means adapted to receive the first refrigerant stream exiting the heat exchanger(s) and compress the refrigerant to a first level of compression;

a second compression means adapted to receive a mixture of the second refrigerant stream exiting the heat exchanger(s) and the compressed refrigerant stream from the first compression means and compress the mixture to form a compressed refrigerant stream;

means for directing the refrigerant in the compressed refrigerant stream into the heat exchanger(s) to be cooled;

means for delivering the cooled refrigerant to an expansion means and then delivering the expanded refrigerant into the heat exchanger(s); and means for splitting the compressed refrigerant stream into two separate refrigerant streams that form the first and second refrigerant streams that feed into the heat exchanger and wherein said splitting of the compressed refrigerant stream occurs either prior to or during said cooling of the compressed refrigerant in the heat exchanger.

Particular configurations of the refrigeration assemblies of the present invention will be apparent from the description of particular embodiments of the invention provided herein.

The processes and refrigeration assemblies of the present invention can be used for any industrial application where cooling below −30° C. is required. Typically the process will be applied to applications where cooling to temperatures below, for example, −50° C. or −80° C. is required. For the liquefaction of natural gas, cooling to below about −150° C. and about −160° C. is required.

Although the refrigeration process and assemblies of the present invention can be used for any industrial application, they are particularly suited to the liquefaction of gases, such as air, oxygen, $CO_2$, nitrogen, and natural gas.

In a particular embodiment, the processes of the invention are processes for the liquefaction of natural gas.

The simple design of the process of the present invention means that it can be put into effect using simpler and more compact equipment configurations. This means that the processes and assemblies of the present invention are suitable for housing on a mobile unit, such as, for example, a shipping vessel. Thus, liquid natural gas, for example, can be piped directly onto a shipping vessel where it is liquefied. This is known in the art as Floating Production Storage and Offloading (FPSO) and it obviates the requirement for large land-based liquefaction plants. FPSO is attractive because it provides additional logistical flexibility for the efficient delivery of liquid natural gas.

The present invention can also be used in small-scale liquid natural gas facilities (known in the art as peak-shaving liquid natural gas facilities) which are used for supplementing large-scale liquefied natural gas production at times of peak demand which exceeds the operating capacity of the large-scale facility.

The present invention can be also used for other industrial applications where low refrigeration temperatures are needed, for example, in ethylene production, cryogenic air separation and the cryogenic removal of carbon dioxide. For these sub-ambient processes, a significant amount of refrigeration duty is needed to enable the separation and/or recovery of the desired hydrocarbons and/or chemicals, and the process of the present invention can be employed to improve the thermodynamic efficiency of refrigeration cycles.

In an embodiment of the invention, the product feed stream is selected from natural gas, air, oxygen, nitrogen, carbon dioxide or mixtures thereof.

In a particular embodiment of the invention, the product feed stream to be cooled is natural gas.

In a further embodiment of the invention, the product feed stream to be cooled is air.

In a further embodiment of the invention, the product feed stream to be cooled is carbon dioxide.

In a further embodiment of the invention, the product feed stream to be cooled is oxygen.

In a particular embodiment of the invention, the product feed stream to be cooled is nitrogen.

EMBODIMENTS OF THE PRESENT INVENTION

The following section describes some particular embodiments of the present invention in reference to the accompanying Figures. Where appropriate, like reference numerals are used to denote like or corresponding parts in different Figures.

The processes according to the present invention are all single cycle refrigerant systems that take advantage of the provision of multiple pressure and/or temperature levels for refrigerant evaporation. Furthermore, in some embodiments, a flash unit is utilised to vary the composition of the cooling refrigerant streams. These processes enables the temperature enthalpy cooling curves for the feed gas stream to be matched as closely as possible and it is this close matching that enables the thermodynamic efficiency of the refrigeration cycle to be improved.

When compared with known single mixed refrigerant cycles, the new mixed refrigerant cycles of present invention defined herein comprise a number of significant process variations. However, the process still remains comparatively simple, and the equipment configuration required to implement the process is also much simpler than that required for the more complex multi-stage or cascade processes. The provision of a simple equipment configuration is particularly important for Floating Production Storage and Offloading (FPSO) vessel applications, in which the compactness and weight of the equipment carries a higher priority, rather than plant capacity and cycle efficiency.

(i) Embodiment 1 (FIG. 1)

Multi-Stage Expansion

In order to have multiple pressure levels for refrigerant evaporation in the first and second refrigerant streams, the present invention provides a simple refrigeration process that employs multiple levels of expansion. As shown in FIG. 1, the single compressed mixed refrigerant stream 1 is pre-cooled in the heat exchanger 2 to form a cooled mixed refrigerant stream 3. The cooled mixed refrigerant stream then undergoes an initial expansion in the expander (or expansion valve) 4 to form a mixed refrigerant stream 5 at an intermediate pressure. The intermediate pressure level stream 5 is then split into two streams (6 and 7). Stream 6 forms the second refrigerant feed stream that evaporates at the intermediate pressure level. Stream 7 is further expanded to a lower pressure level in the expander 8 and forms the first refrigerant stream that feeds into the heat exchanger 2.

The first and second refrigerant streams (6 and 7) are fed into the heat exchanger 2, where they provide cooling to single compressed refrigerant stream 1 and the process feed stream 9, which emerges for the heat exchanger as a cooled process stream.

For the liquefaction of natural gas, the process feed stream 9 is a feed stream of natural gas which undergoes an initial cooling in the heat exchanger 2 and is then fed into a flash unit 30, which separates any liquefied components 9*a* from gaseous components 9*b*. The gaseous components 9*b* are withdrawn and are subject to further cooling in the heat exchanger 2, whereas the liquefied components 9*a* can be withdrawn for storage.

The first refrigerant stream 7, upon exiting the heat exchanger 2, is directed to a first compressor 10, where it undergoes an initial compression to a pressure that is the same as, or proximate to, that of the second refrigerant stream 6. The compressed first stream 7 is then mixed with the second refrigerant stream 6 from the heat exchanger in the second compressor 11. The second compressor compresses the combined refrigerant streams 6 and 7 to re-form the single compressed refrigerant stream 1. The whole cycle is repeated continuously.

Since the first and second refrigerant streams (6 and 7) evaporate at different pressure levels, they have different temperature-enthalpy profiles. The shape of the cold composite curve, a combination of the temperature-enthalpy profiles of the first and second refrigerant streams (6 and 7), can now be manipulated by changing two pressure levels for refrigerant evaporation (instead of just one for the traditional single mixed refrigerant cycle with a single refrigerant stream). Consequently, the ability to manipulate the temperature-enthalpy profiles in this way provides additional operational flexibility. Furthermore, the provision of this additional operation variability, together with the additional variability provided by the provision of two refrigerant streams, and the possibility to vary the ratio at which the streams are split, provides further options for optimising the efficiency of the process. Thus, it provides the potential for improved efficiency relative to a traditional single MR cycle.

Figure 2:
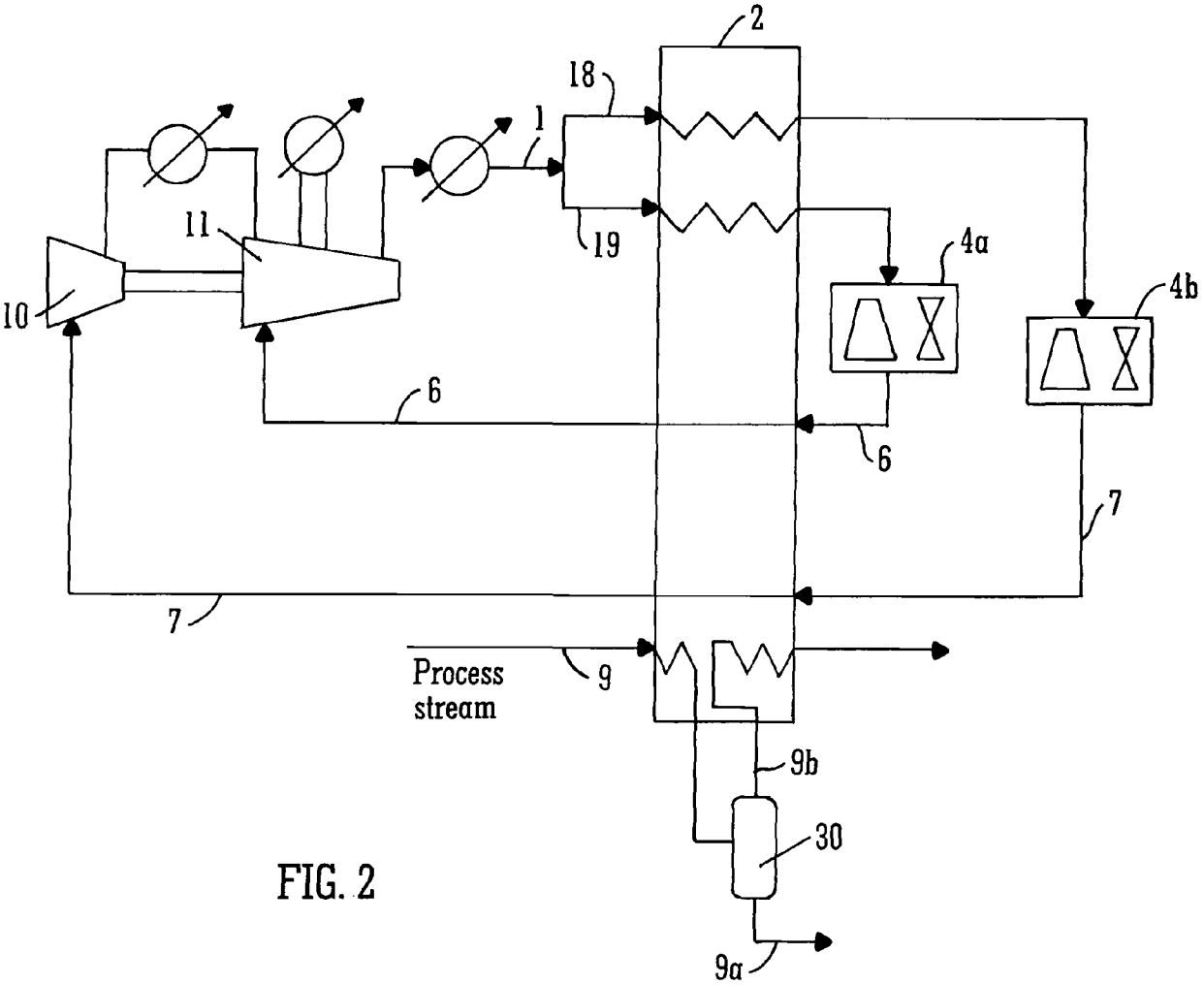
FIG. 2 is a schematic diagram showing a second embodiment of the present invention.

(ii) Embodiment 2 (FIG. 2)

Multi-Stream Pre-Cooling

The cooling effect during expansion is limited, so the temperatures of the streams 6 and 7 in the process of FIG. 1 will be very close to one another (since they have the same temperature level before the first-stage expansion). As a consequence, this feature of this particular process configuration imposes some constraints on the manipulation of stream temperature-enthalpy profiles. In order to overcome this structural limitation and allow the two refrigerant streams to have different temperatures, a further modified embodiment of the process was developed as shown in FIG. 2.

The embodiment shown in FIG. 2 is the same as the embodiments shown in FIG. 1 in many respects, but the main difference is that the single compressed refrigerant stream 1 is split to form two separate streams 18 and 19 before the refrigerant stream is pre-cooled in the heat exchanger 2.

The temperatures of both refrigerant streams 18 and 19 after pre-cooling can be different by varying the degree of cooling for each of the streams 18 and 19 in the heat exchanger (and this implies these two refrigerant streams are able to evaporate over different temperature ranges). Each of the cooled process streams 18 and 19 are then expanded separately in the expanders or expansion valves 4*a* and 4*b* to provide the first and second refrigerant streams 6 and 7. The refrigerant from streams 6 and 7 is then recycled as described in reference to FIG. 1.

Thus, this embodiment provides additional operational flexibility by enabling, if desired: (i) the temperature (by differential pre-cooling in the heat exchanger 2); (ii) the pressure (by differential expansion in expanders or expansion valves 4*a* and 4*b*), and (iii) the ratio at which the refrigerant is split between streams 18 and 19 to all be varied.

Furthermore, this process does not possess the structural constraints imposed by using more complex multi-stage expansion processes.

When refrigeration is required to cool a process feed stream over a moderate temperature range, pressure and temperature levels for refrigerant evaporation have a great impact on the shape of stream temperature-enthalpy profiles. Consequently, the ability to vary the temperature and pressure of the first and second refrigerant streams in this embodiment provide additional flexibility to enable the thermodynamic efficiency to be improved.

Figure 3:
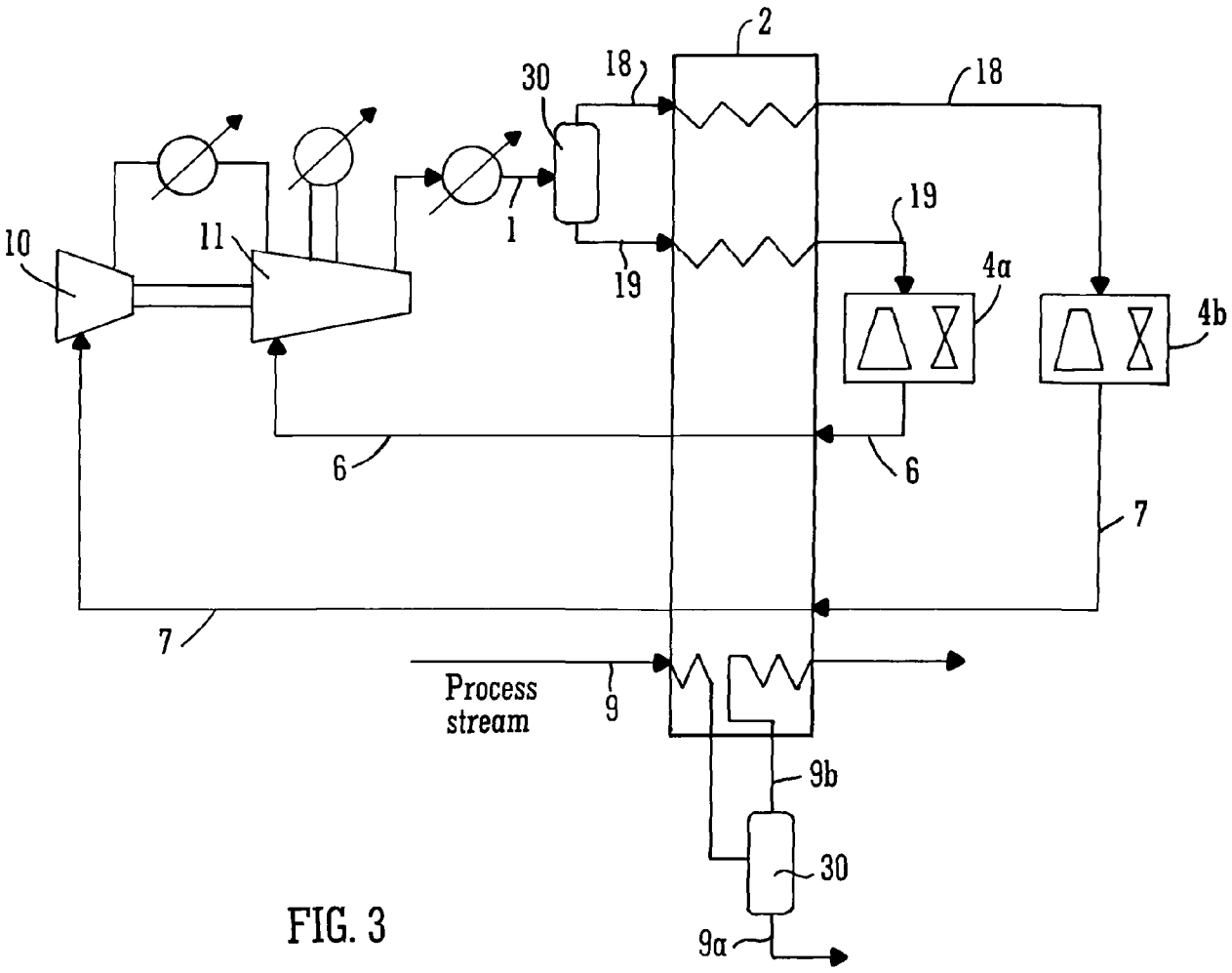
FIG. 3 is a schematic diagram showing a third embodiment of the present invention.
Figure 4:
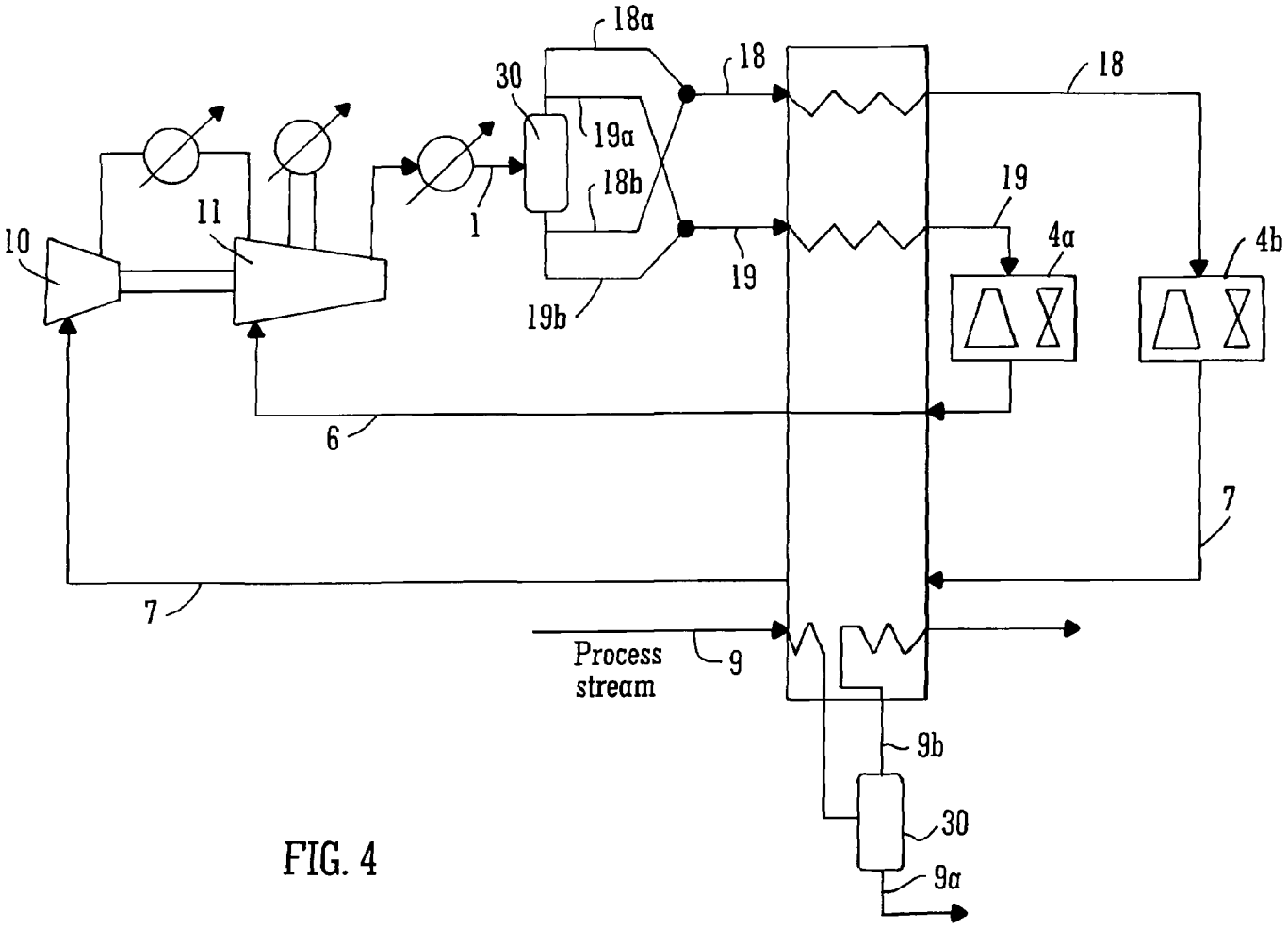
FIG. 4 is a schematic diagram showing a fourth embodiment of the present invention.
Figure 11:
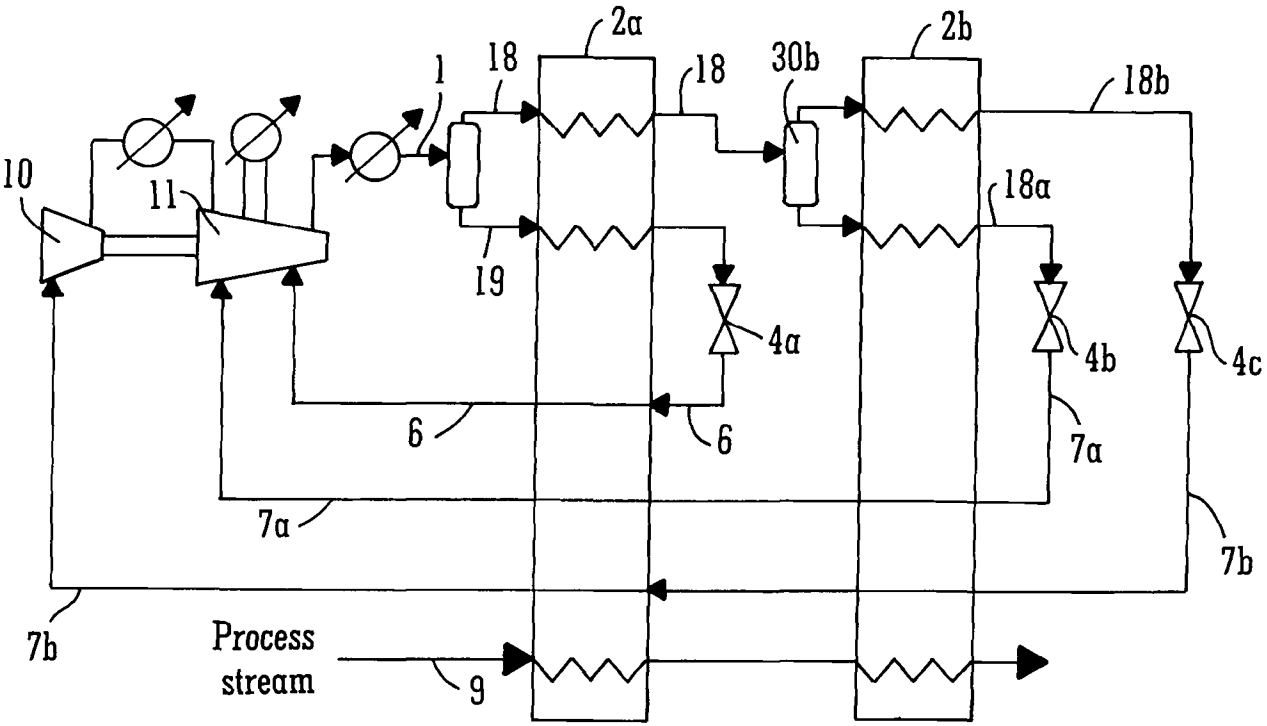
FIG. 11 is a schematic diagram showing a fifth embodiment of the present invention.

(iii) Embodiments 3, 4 and 5 (FIGS. 3, 4 and 11)

Flash Unit Embodiments

The simple stream splitting employed in the embodiments described in FIGS. 1 and 2 above still has a limitation in that the two refrigerant streams both have an identical composition.

If refrigeration is required over a wide temperature range, the effect of pressure and temperature levels alone on the thermodynamic performance can be limited. Another critical factor, refrigerant composition, plays a more significant role in enabling the optimisation of the temperature-enthalpy profiles of the refrigerants in such cases. Therefore, the ability to provide separate refrigerant streams with different compositions within a single mixed refrigerant cycle enables the more effective manipulation of the temperature-enthalpy profiles and the operational efficiency to be improved.

Certain embodiments of the invention make use of isobaric flash by incorporating a flash unit. Isobaric flash is an established technique which produces two product streams with different compositions, one in vapour and the other in liquid. For mixed refrigerants, the flow rate and composition of the product streams are determined by the vapour-liquid equilibrium and can be obtained with flash calculations. With the adjustment of flash conditions, including pressure and temperature levels, as well as the feed stream composition, the flow rate and compositions of the product streams change accordingly. If a single mixed refrigerant cycle is able to capture these features of flash operation, then the cycle optimisation can be more flexible by offering two refrigerant streams with different compositions. The following two embodiments shown in FIGS. 3 and 4 have been developed to take advantage of flash operations to improve the thermodynamic efficiency.

Pre-Flash Embodiment

Embodiment 3, FIG. 3

The embodiment shown in FIG. 3 is the same as that shown in FIG. 2, except that, prior to being pre-cooled within the heat exchanger 2, the single compressed refrigerant stream 1 is split into two separate streams 18 and 19 in a flash unit 30. The compressed mixed refrigerant feed stream 1 is a mixture of vapour and liquid, which is separated in the flash unit 30 to provide the two product streams 18 and 19. Stream 18 comprises vapour extracted from the top of the flash unit 30, and stream 19 comprises liquid extracted from the bottom of the flash unit.

Stream 18, which comprises vapour, is subject to greater pre-cooling in the heat exchanger 2 to convert the vapour into liquid. This provides two liquid refrigerant streams 18 and 19 of differing composition which are then expanded in the expanders or expansion valves 4*b* and 4*a* respectively to form the first and second refrigerant feed streams 6 and 7 respectively. The refrigerant is then recycled as described above in reference to FIG. 1.

In this embodiment, the composition of the two refrigerant streams in the heat exchanger can be varied by the adjustment of the flash conditions. This provides further operational variability by enabling the temperature-enthalpy profile of the refrigerant to be further manipulated. This enables the closer matching of the refrigerant's profile to the composite cooling curve of the process stream. Consequently, this process has much greater operational variability than a single mixed refrigerant cycle.

It shall be appreciated that in this pre-flash embodiment, the condition of the refrigerant streams 18 and 19 is completely determined by the flash calculations. The only way to adjust the conditions of these streams is to change the condition of the feed stream. Consequently, the condition selection for flash product streams in this process is a limiting factor.

Pre-Flash with Stream Allocation

Embodiment 4, FIG. 4

A further alternative embodiment of the invention is shown in FIG. 4. This embodiment comprises additional flexibility to eliminate the limitations of flash product allocation.

The embodiment shown in FIG. 4 is the same as that shown in FIG. 3 in that it uses a flash unit 30 to produce streams 18 and 19 with different compositions. However, the vapour and liquid streams extracted from the flash unit 30 do not serve as the refrigerant streams directly as they do in the pre-flash embodiment (FIG. 3). Instead, the actual refrigerant compositions are formed by mixing a portion of the extracted vapour stream with a portion of the extracted liquid stream from the flash unit 30. Thus, the stream 18 is formed from a portion 18*a* of the vapour stream and a portion 18*b* of the liquid steam from the flash unit 30. Likewise, the remaining portion of the vapour stream 19*a* and the remaining portion of the liquid stream 19*b* are combined to form the refrigerant stream 19.

By varying the amount of vapour and liquid phase in each refrigerant stream, the composition of the refrigerant streams can be further optimised for the cooling of the desired process stream 9. Even for fixed feed stream conditions, the flow rate and compositions of both refrigerant streams can still be varied by altering the flow ratio. This therefore provides further operational variability to enable the optimisation of the thermodynamic efficiency.

Although in the embodiment shown in FIG. 4, refrigerant splitting and mixing results in additional exergy loss, the additional operational variability and the selection of refrigerant pre-cooling and evaporation conditions helps to match overall hot and cold composite curves of the process streams more closely and reduce the exergy loss during heat exchange. Thus, the pre-flash with stream allocation scheme has the potential to vastly improve the cycle efficiency if the benefit of more efficient heat exchange outweighs the negative effect caused by refrigerant splitting and mixing.

Pre-Flash with Two Heat Exchangers

Embodiment 5, FIG. 11

FIG. 11 shows a further embodiment which is similar in construction to the pre-flash embodiment (embodiment 3) described above in reference to FIG. 3. In this embodiment, the single compressed refrigerant stream 1 is introduced into a first flash unit 30*a* where it is separated into two refrigerant streams 18 and 19 in the same manner as described in reference to embodiment 3 (FIG. 3) above.

The first refrigerant stream 19 is pre-cooled in the first heat exchanger 2*a* and is then passed through an expansion chamber or expansion valve 4*a* to form an expanded refrigerant stream 6 which forms the first refrigerant stream in the heat exchanger 2*a*. The first refrigerant stream 6 is then recycled back to the compressed refrigerant stream 1 in the same way as previously described in relation to embodiments 1 and 3 (FIGS. 1 and 3).

The second refrigerant stream 18 is also pre-cooled in the heat exchanger 2*a* and is then fed into a second flash unit 30*b* where it is separated into two refrigerant streams 18*a* and 18*b*. The refrigerant streams 18*a* and 18*b* are then subjected to pre-cooling in a second heat exchanger 2*b* which is positioned in series with the heat exchanger 2*a*. The two pre-cooled refrigerant streams 18*a* and 18*b* are then subjected to expansion by the expansion chamber/expansion valves 4*b*, 4*c* to produce two separate refrigerant streams 7*a* and 7*b*, which pass into the second heat exchanger 2*b* and are then fed into the first heat exchanger 2*a* to provide coolant to the process stream 9.

The refrigerant stream 7*a* is typically at a higher pressure than the refrigerant stream 7*b*. Accordingly, it is necessary for refrigerant stream 7*b* to be subjected to an initial compression in the first compressor 10 in order to increase the pressure of this refrigerant to a level which is the same as, or proximate to, that of the refrigerant stream 7*a*. The refrigerant streams 7*a*, 7*b*, 6 are then all mixed and compressed in the compressor 11 to form the single compressed refrigerant stream 1 which is then recycled back into the flash unit 30*a*.

Suitably, the refrigerant stream 6 is at a high pressure, refrigerant stream 7*a* is at a lower/intermediate pressure and refrigerant stream 7*b* is at the lowest pressure.

The provision of two heat exchangers (2*a* and 2*b*) and the refrigerant streams (6, 7*a* and 7*b*) enables the properties of the refrigerant streams to be optimised for the cooling of the process stream 9. This optimisation is enhanced by the provision of additional variables that enable the refrigerant composition and pressures to be optimised to provide cooling profile to the process stream concerned. However, this embodiment also requires a relatively more elaborate and expensive construction.

Particular examples of the how the invention may be put into practice will now be described in reference to the following Example.

Example

Process Modelling and Optimisation

For each embodiment described above in reference to FIGS. 1 to 4, the independent variables in the process are identified first, and then physical property calculations, mass balance and energy balances are implemented to compute other intermediate operating conditions and evaluate the overall performance of the refrigeration process. The physical property calculation is based on Equation of State (for example, Peng-Robinson method) which provides thermodynamic information between stream conditions (composition, temperature, pressure) and physical properties (enthalpy, entropy). In principle, once the composition is given, the physical state of a stream is determined by any two of the following parameters: temperature, pressure, specific enthalpy and specific entropy. This feature is utilised to calculate stream enthalpy change in the heat exchanger, and to determine the stream conditions after expansion and compression. If stream mixing or splitting is in presence, then mass balance is applied to calculate the composition and flow rate of the product streams.

Process modelling of the new refrigeration cycles also includes the evaluation of feasibility of heat transfer in the heat exchanger. For a heat exchange system comprising three or more streams, like the system studied here, feasible heat transfer can only be fully satisfied, if the temperature difference between the hot composite curve and the cold one is not less than a specified minimum value. Thus, in order to ensure that heat exchange can be successfully implemented throughout the heat exchanger, it is necessary to construct and compare the hot and cold composite curves for this heat exchange system. Once the hot composite curve and the cold one are constructed, the feasibility check is carried out along both curves.

Once the physical state of all process streams are obtained by physical property calculations, the shaft power consumption of refrigerant compressors and the ambient cooling duty can be calculated according to mass and energy balances. The multi-stage compression is used with inter-cooling.

In this modelling section, shaft power consumption has been chosen as the main objective for minimisation. However, if there is available data to correlate equipment size and costs, then the capital investment can also be considered during the process design with the objective function replaced by total annualised cost.

Simulation is utilised to evaluate the performance of all the refrigeration cycles described in references to FIGS. 1 to 4. However, for the embodiments shown in FIGS. 3 and 4, both of which comprise a flash unit 30, the actual refrigerant composition needs to be determined first by flash calculations, before the expansion process is simulated. After the simulation of major equipment, such as expansion device, heat exchanger and multi-stage compressors, the performance indicator, shaft power consumption, as well as the feasibility indicator, degree of violation of temperature driving force (widely known as minimum temperature approach, $\Delta T_{min}$) in heat exchanger, is obtained from the simulation. With these two parameters, the final objective function is determined, and used for the evaluation of candidate fitness during GA (genetic algorithm) optimisation.

The performance of refrigeration systems strongly depends on the selected operating conditions. By adjusting these operating conditions, the system performance might be improved. The problem of refrigeration system design is highly non-linear, with abundant local optima existing within the searching space. Due to this feature, the optimisation can be easily trapped in one of the local optima if traditional deterministic methods are employed for solving the problem. Therefore, a stochastic optimisation technique provides advantages for better confidence of the final optimal solution(s) over traditional deterministic methods. Stochastic optimisation techniques, such as Genetic Algorithm (GA) and Simulated Annealing (SA), have been widely applied in process design and engineering problems. GA is selected for the optimisation of this problem.

The overall GA optimisation is comprised of two stages, initialisation, or generation of initial population, and evolution. The GA based optimisation begins with generating an initial population of candidates, with each candidate representing a set of operating conditions. A screening process is introduced to filter out those candidates with poor quality and keep the ones with better fitness in the initial population. Although generating high quality candidates takes more time for the initialisation stage, the time consumed in the evolution part can be reduced due to the start from initial population with a better quality. The quality of a candidate is mainly judged by its feasibility, which is obtained from the simulation. If a candidate is feasible or only has acceptable temperature violations in the heat exchanger, it is kept in the initial population. After the initial population is produced at the initialisation stage, the generated candidates are manipulated by GA operators: selection, crossover and mutation to reproduce next generation. Fitness of a candidate has a strong impact on the possibility of passing its features down to the next generation. Candidates in the new generation are more likely to inherit characteristics from candidates with better fitness. When the last generation is reached, the best candidate is returned as the final optimal solution.

Figure 5:
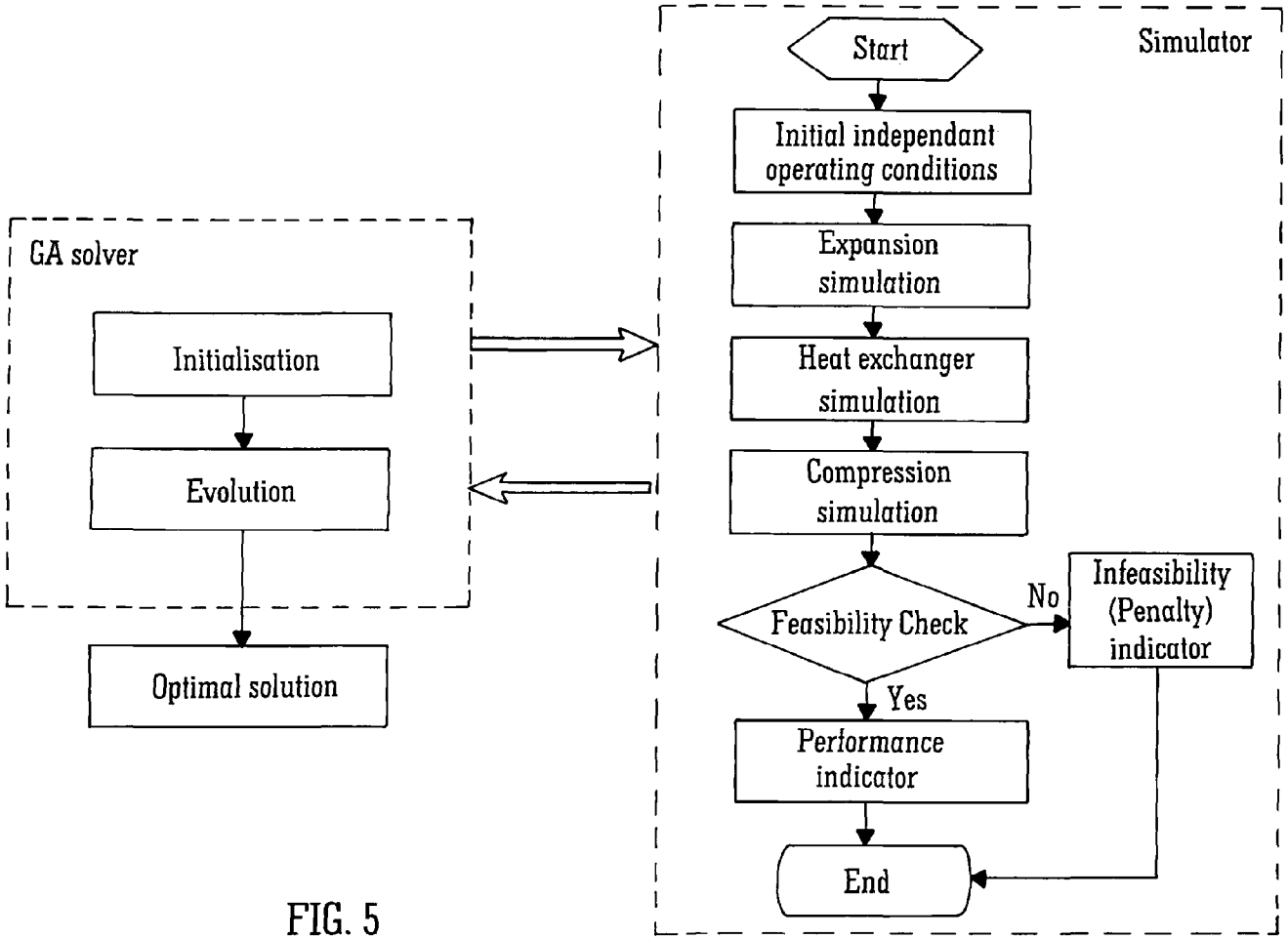
FIG. 5 is a schematic diagram showing a genetic algorithm optimisation framework.

The GA optimisation framework is shown in FIG. 5. Each candidate is a set of independent operating conditions. The fitness of each candidate is a reflection of the performance indicator evaluated by process simulation. In this research, shaft power consumption is selected as the main objective for minimisation, although a penalty term is also contributing to the objective function to allow for reasonable degree of infeasibility in the heat exchanger.

Case Studies

Two different cases are utilised in this section to illustrate the performance of new schemes proposed herein. The first case (Case Study 1) was originally published in Vaidyaraman et al. (2002), in which a natural gas stream is required to be refrigerated from ambient temperature to around −60° C., a fairly moderate temperature level. The other case (Case Study 2) cited from Lee (2002) is to optimise the performance of a LNG production process. In this case, the feed gas stream needs to be cooled from the ambient temperature to −160° C., a very low temperature level.

For both cases, optimisation was carried out for all the new MR cycle schemes to obtain their best energy performance. Additional efforts have been made to ensure the optimisation is implemented on the same design basis. The multi-stage compression model is applied during the optimisation to reflect the best performance that each individual process is able to offer. Additionally, particular specification of maximum pressure ratio is made for each process, so that all of the optimal solutions can keep a similar number of compression stages, which has a significant impact on process shaft power consumption. Once the final solutions are obtained for each process, advantages of different schemes are identified. And these useful guidelines can be applied to select proper schemes for a given refrigeration task.

Case Study 1

A pre-treated natural gas stream is to be cooled from 19.85° C. to −58.15° C. using a mixture of hydrocarbons $C_2H_6$, $C_3H_8$, and n-$C_4H_{10}$ as the refrigerant components. The objective is to minimise the compression power consumption. External cold utility is available to cool hot refrigerant to 40° C. The minimum temperature difference for feasible heat transfer is 2.5° C. Compressor isentropic efficiency is assumed to be 80%. To be consistent with previous work by Vaidyaraman et al. (2002), physical property calculations are conducted with SRK (Soave-Redlich-Kwong) equation of state. The temperature-enthalpy profile of the natural gas stream is given in Table 1.

TABLE 1

Temperature-enthalpy profile of the natural gas stream.

| Temperature (° C.) | Enthalpy (kW) |
|---|---|
| 19.85 | 3969.838 |
| 11.52 | 3608.943 |
| 3.26 | 3248.05 |
| −4.92 | 2887.157 |

TABLE 1-continued

Temperature-enthalpy profile of the natural gas stream.

| Temperature (° C.) | Enthalpy (kW) |
|---|---|
| −12.97 | 2526.262 |
| −20.86 | 2165.368 |
| −28.55 | 1804.474 |
| −35.98 | 1443.579 |
| −41.45 | 1167.567 |
| −42.78 | 1082.685 |
| −48.27 | 721.791 |
| −53.42 | 360.896 |
| −58.15 | 0 |

A conventional single mixed cycle and all the novel refrigeration processes described in references to FIGS. 1 to 4 have all been designed to meet the refrigeration demand specified in this case. A range of performance indicators for each refrigeration process have been chosen for comparison.

As an important performance indicator, shaft power consumption reflects the energy efficiency of each process, with higher shaft power consumption representing lower cycle efficiency. Additionally, the number of compressor stages has also been selected for comparison as this parameter not only significantly affects cycle efficiency, but also determines the structural complexity of refrigeration processes. If any refrigeration process achieves better cycle efficiency than others, but requires more compression stages, then the efficiency improvement may not come from variations of process configurations, but may in fact be due to more inter-cooling between compression stages. Therefore, in order to obtain a fair comparison among various processes, maximum pressure ratio for compression stages has been carefully selected for each process during optimisation. And the resulting number of compressor stages has to be equal to or close to 4. Moreover, the indicator of feasible heat exchange, i.e. minimum temperature difference, has also been included in the comparison table as full achievement of feasible heat transfer across heat exchanger is essential for refrigeration process design. Above performance indicators of all the refrigeration processes are obtained after GA optimisation, as shown in Table 2.

TABLE 2

Performance comparison among refrigeration processes (Case Study 1)

| Refrigeration Process | Shaft power Consumption (MW) | Relative Reduction | Comp. stages Max PR | Comp. stages No. | Min. ΔT (° C.) |
|---|---|---|---|---|---|
| Single MR Cycle | 1.986 | — | 2.5 | 4 | 2.5 |
| Multi-stage Expansion (Embodiment 1) | 1.79 | 9.87% | 2.5 | 4 | 2.5 |
| Multi-stream Pre-cooling (Embodiment 2) | 1.772 | 10.78% | 2.5 | 4 | 2.5 |
| Pre-Flash (Embodiment 3) | 1.984 | 0.10% | 2.5 | 4 | 2.5 |
| Pre-Flash with Stream Allocation (Embodiment 4) | 1.777 | 10.52% | 2.5 | 4 | 2.53 |

Single MR Cycle

The best design of a single MR cycle is illustrated in FIG. 6(*a*). The hot and cold composite curves and stream temperature-enthalpy (T-H) profiles are shown in FIG. 6(*b*). As can be seen in FIG. 6, although a close match is observed at the lower end, there is a large gap between composite curves in the high temperature section. Such a large gap implies the cycle efficiency is very low due to considerable thermodynamic irreversibility and the resulting exergy loss during heat exchange. No temperature cross can be observed between composite curves, and feasibility of heat transfer in the heat exchanger is fully achieved.

Multi-Stage Expansion

The best design for multi-stage expansion scheme is shown in FIG. 7(*a*). Composite curves and stream T-H profiles in the heat exchanger are illustrated in FIG. 7(*b*). As can been seen in FIG. 7, although the hot refrigerant is pre-cooled in a single stream, the two cold refrigerants after stream splitting evaporate at different pressure levels and produce T-H profiles over different temperature ranges. As a result, the combined cold composite curve matches the hot one very closely, contributing to the reduction of shaft power consumption.

However, as a consequence of single stream pre-cooling, the low end temperatures of both cold refrigerants are quite close (because the cooling effect of stream expansion is very limited). This greatly restricts the condition selection for refrigerant evaporation. The simple way to remove such a structural limitation is to introduce multi-stream pre-cooling.

Multi-Stream Pre-Cooling

The best design for multi-stream pre-cooling scheme is shown in FIG. 8(*a*). Composite curves and stream T-H profiles in the heat exchanger are illustrated in FIG. 8(*b*). In contrast to the previous MR cycle schemes, the two hot refrigerant streams are pre-cooled to different temperature levels and the condition selection for cold refrigerant evaporation becomes more flexible. As can be seen in FIG. 8, two cold refrigerants provide process cooling over different temperature ranges and the composite curves are matched closely. Moreover, when comparing this design with the best one for the multi-stage expansion scheme, it can be seen that the amount of circulating refrigerant required is less. Additionally, the refrigerant contains a lower proportion of $C_2H_6$, which is more difficult for compression than the other two components. All these features contribute to a further reduction to shaft power consumption.

Pre-Flash Scheme

The best design for the pre-flash embodiment is illustrated in FIG. 9(*a*). Composite curves and stream T-H profiles in the heat exchanger are shown in FIG. 9(*b*).

In this design, it shall be noted that the vapour product flow rate is zero after the flash separation. This implies that the pre-flash scheme has degenerated to the traditional single MR cycle in this particular case, as the lower level refrigerant is not present. Similar shaft power requirement to that of the single MR cycle design also accounts for this process degeneration.

Pre-Flash with Stream Allocation Scheme

The best design for pre-flash with stream allocation scheme is illustrated in FIG. 10(*a*). Composite curves and stream T-H profiles in the heat exchanger are shown in FIG. 10(*b*). In this scheme, the actual refrigerant streams are obtained by partially mixing the vapour and liquid products from the flash unit. It provides additional flexibility to adjust the composition and flow rate of the actual refrigerant streams in the heat exchanger. Hence, this scheme can match the composite curves more closely than the pre-flash scheme, in which the flash products directly serve as refrigerant streams, and accordingly save the shaft power consumption.

From the result summary shown in Table 2, it can be seen that three out of four of the embodiments of the present invention can improve the cycle performance by around 10%, with new degrees of freedom introduced and more heat integration opportunities created. The pre-flash scheme fails to offer better cycle efficiency in this particular case and degenerates to a single MR cycle in the best design. This implies the structure restriction, i.e. no stream allocation after flash separation, has considerable negative impacts on cycle efficiency improvement in this specific case. However, this limitation can be removed by allocating and mixing the product streams from the flash unit, as applied in the pre-flash with stream allocation embodiment.

In order to validate the best designs illustrated in Table 2, all the process configurations have been simulated in the commercial process simulation package ASPEN HYSYS®. Table 3 shows the result comparison between the major performance parameters obtained in this work and the simulation results in ASPEN HYSYS®. As can be seen, both parameters, the shaft power consumption and the minimum temperature difference, have very close simulation results. Thus, the process modelling techniques applied in this work have achieved satisfactory accuracy.

TABLE 3

Performance parameter comparison for result validation (Case Study 1)

| | Simulation results in this work | | Simulation results in ASPEN HYSYS ® | |
|---|---|---|---|---|
| Refrigeration Process | Shaft power consumption (MW) | Min. ΔT (° C.) | Shaft power consumption (MW) | Min. ΔT (° C.) |
| Single MR Cycle | 1.986 | 2.5 | 1.985 | 2.34 |
| Multi-stage Expansion (Embodiment 1) | 1.79 | 2.5 | 1.786 | 2.5 |
| Multi-stream Pre-cooling (Embodiment 2) | 1.772 | 2.5 | 1.774 | 2.46 |
| Pre-Flash (Embodiment 3) | 1.984 | 2.5 | 1.985 | 2.3 |
| Pre-Flash with Stream Allocation (Embodiment 4) | 1.777 | 2.53 | 1.779 | 2.6 |

Case Study 2

In this study, existing processes as well as the four embodiments of the present invention, were optimised for LNG production. A pre-treated natural gas stream is to be cooled from ambient temperature 25° C. to −163° C. A mixture of hydrocarbons $CH_4$, $C_2H_6$, $C_3H_8$, n-$C_4H_{10}$ and $N_2$ is employed as the mixed refrigerant. The objective was to minimise the compression power consumption based on multi-stage compression. External cold utility is available to cool hot refrigerant down to 30° C. The minimum temperature difference for heat transfer is 5° C. Compressor isentropic efficiency is assumed to be 80%. The physical property calculations are performed based on Peng-Robinson equation of state. The temperature-enthalpy profile of the natural gas stream is given in Table 4.

TABLE 4

Temperature-enthalpy profile of the natural gas stream.

| Temperature (° C.) | Enthalpy (kW) |
|---|---|
| 25 | 20178.8 |
| −6.03 | 18317 |

TABLE 4-continued

Temperature-enthalpy profile of the natural gas stream.

| Temperature (° C.) | Enthalpy (kW) |
|---|---|
| −34.09 | 16352.8 |
| −57.65 | 14468 |
| −70.1 | 11978 |
| −74.55 | 10198 |
| −82.26 | 7114 |
| −96.5 | 5690 |
| −115 | 3840 |
| −163 | 0 |

In order to have a benchmark of shaft power consumption for LNG production, the APCI propane pre-cooled mixed refrigerant process, a widely used LNG production process in current industrial practice, was also modelled and optimised with the approach described herein. The propane pre-cooling cycle is assumed to provide process cooling at four different pressure levels and the mixed refrigerant in the main cryogenic cycle is comprised of $CH_4$, $C_2H_6$, $C_3H_8$, n-$C_4H_{10}$ and $N_2$. Operating conditions for propane and the mixed refrigerant, as well as the composition of mixed refrigerant, were all optimised under the GA optimisation framework. At the end of GA optimisation, the best design with minimum shaft power consumption is obtained as the benchmark for comparison in Table 5.

TABLE 5

Result summary of various LNG production processes (Case Study 2)

| Refrigeration Process | Shaft power Consumption (MW) | Relative Reduction | Number of Comp. Stages |
|---|---|---|---|
| Single MR Cycle | 28.27 | — | 4 |
| Multi-stage Expansion (Embodiment 1) | 28.2 | 0.25% | 4 |
| Multi-stream Pre-cooling (Embodiment 2) | 27.42 | 3.01% | 5 |
| Pre-Flash (Embodiment 3) | 26.6 | 5.91% | 4 |
| Pre-Flash with Stream Allocation (Embodiment 4) | 26.05 | 7.85% | 4 |
| APCI C3/MR process | 24.82 | 12.2% | 7 |

As shown in Table 5, the single MR cycle has the lowest cycle efficiency and consumes 28.27 MW shaft power to drive refrigerant compressors. The refrigeration process of the highest efficiency is the APCI C3/MR process, which is able to reduce the shaft power consumption by 12.2% compared with the single MR cycle. Shaft power consumption of the best multi-stage expansion design is very close to that of the single MR cycle design and the best design has a very low refrigerant flow rate of 0.0299 kmol/s at the intermediate pressure level. This implies it has degenerated to a single MR cycle. For the multi-stream pre-cooling embodiment, as it is not able to avoid the structural limitations caused by simple stream splitting and identical compositions for both refrigerant streams, the cycle efficiency is only slightly improved by around 3%. In the pre-flash embodiment and the embodiment with stream allocation, the shaft power requirement is reduced by around 6% and 8% respectively. Both of them benefit from the creation of refrigerant streams with different compositions and exhibit higher cycle efficiency than other single MR cycle schemes without flash operations. It can also be noted that introducing stream allocation will further enhance the cycle performance by more flexible selection of flow rates and compositions for the actual refrigerant streams.

The APCI C3/MR process shows its advantage over other refrigeration processes in terms of energy efficiency, but it has a much more complicated process configuration than the others evaluated. First of all, it requires 7 refrigerant compressor stages in total, four stages for propane compression and three stages for mixed refrigerant compression. More compression stages significantly increase the process complexity and also has a negative effect on process overall reliability, as more pieces of equipment are involved. Secondly, the propane pre-cooling cycle requires a complicated propane separation and distribution network, which also considerably increases the process complexity. For refrigeration applications that have no restrictions on process complexity, the APCI C3/MR process can be a good option for its efficient provision of process cooling. However, if applications have particular constraints on structural complexity or weight, then the refrigeration processes of the present invention will be advantageous because of their simple and compact structure with improved cycle efficiency. Moreover, with less equipment involved, these processes should also benefit from higher reliability than more complicated processes, such as the APCI C3/MR process.

From the above, the optimisation results of two different cases, it can be seen that each scheme can demonstrate a different effect on cycle performance improvement for different refrigeration tasks. In the first case, temperature decrease of the natural gas stream is moderate, so the multi-stage expansion scheme and the multi-stream pre-cooling scheme have a good chance to benefit from multiple pressure and temperature levels for refrigerant evaporation, and enhance the cycle performance. However, in the second case, where a wide temperature range is covered in the natural gas liquefaction, both of them can not significantly improve the cycle efficiency, and even have to face the possibility of degeneration to a single MR cycle. In order to improve the cycle performance in those cases with large temperature change, schemes with flash operations are recommended, especially the one with stream allocation. These schemes can take advantage of creating refrigerants with different compositions to adjust the shape of T-H profiles more effectively, hence reduce the shaft power consumption.

Moreover, it should be noted that the pre-flash with stream allocation scheme consistently show a high cycle efficiency in both cases, due to the flexibility introduced by the flash operation and stream allocation. And such a scheme remains a relatively simple machinery configuration.

CONCLUSIONS

The four embodiments of the process of the invention that are based on a single mixed refrigerant cycle provide a comparatively simple equipment configuration yet are able to offer additional operational variables that enable the thermodynamic efficiency of the refrigeration cycle to be improved.

The improved efficiency arises in certain circumstances by taking advantage of multiple pressure and temperature levels of refrigerant evaporation, and, in some embodiments, by the utilisation of a flash unit.

For refrigeration tasks with a moderate temperature change, multi-stage expansion scheme and multi-stream pre-cooling scheme can offer improved cycle efficiency with a fairly simple cycle structure. The refrigerant streams in each scheme evaporate at multiple pressure levels and provide more opportunities to match the overall composite curves closely. When the refrigeration covers a wide temperature range, the effect of multiple pressure and temperature levels on performance improvement is very limited. And in such cases, utilisation of flash units to introduce refrigerants with different compositions will help manipulating the T-H profiles more effectively. Allowing stream allocation will further enhance the cycle efficiency. It is also shown in the results of case studies that the pre-flash with stream allocation scheme can consistently offer high cycle efficiency in both cases, unlike other schemes, for which the cycle performance improvement might rely on the features of specific refrigeration tasks.

REFERENCES

Lee, G. C., Optimal design and analysis of refrigeration systems for low temperature processes, PhD thesis, Department of Process Integration—UMIST, UK, 2001.

Vaidyaraman, S. and Maranas, C. D., Synthesis of mixed refrigerant cascade cycles, *Chemical Engineering Communications*, Vol. 189, No. 8, pp 1057-1078, 2002.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, and characteristics described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments.

The invention claimed is:

1. A refrigeration process for cooling a product feed stream, the process comprising passing the product feed stream through a heat exchanger comprising a first refrigerant stream of mixed refrigerant and a second refrigerant stream of mixed refrigerant; wherein the first refrigerant stream is configured to evaporate at a temperature which is lower than that of the second refrigerant stream; and wherein the first refrigerant stream, upon exiting the heat exchanger, is subject to an initial compression prior to mixing with the second refrigerant feed stream from the heat exchanger to form a single refrigerant stream which is subjected to a second compression to form a compressed refrigerant stream, and wherein:

(i) the compressed refrigerant stream is split into vapour and liquid phases in a flash unit, and a portion of the vapour phase from the flash unit is mixed with a portion of the liquid phase to form the first refrigerant stream and the remainder of the vapour phase is mixed with the remainder of the liquid phase to form the second refrigerant stream; and (ii) the first and second refrigerant streams are then subject to cooling in the heat exchanger followed by expansion prior to being reintroduced into the heat exchanger to cool the feed stream.

2. The process according to claim 1, wherein additional refrigerant streams are provided in the heat exchanger.

3. The process according to claim 1, wherein the temperature and/or pressure of the first refrigerant stream is lower than the pressure and/or temperature of the second stream of mixed refrigerant.

4. The process according to claim 3, wherein the first refrigerant stream is at a pressure that is lower than that of the second refrigerant stream.

5. The process according to claim 1, wherein the product feed stream is selected from the group consisting of natural gas, air, nitrogen, carbon dioxide and oxygen.

6. The process according to claim 1, wherein one or two heat exchangers are provided for cooling the product feed stream.

7. A refrigeration assembly comprising one or more heat exchangers adapted to receive a product stream to be cooled during use and a refrigerant cycle, said assembly comprising:

a first and a second refrigerant stream flowing through the heat exchanger(s) to provide cooling; wherein the refrigerant in the first refrigerant stream is configured to evaporate at a temperature which is lower than that of the refrigerant in the second refrigerant stream;

a first compression means adapted to receive the first refrigerant stream exiting the heat exchanger(s) and compress the refrigerant to a first level of compression;

a second compression means adapted to receive a mixture of the second refrigerant stream exiting the heat exchanger(s) and the compressed refrigerant stream from the first compression means and compress the mixture to form a compressed refrigerant stream;

means for directing the refrigerant in the compressed refrigerant stream into the heat exchanger(s) to be cooled;

means for delivering the cooled refrigerant to an expansion means and then delivering the expanded refrigerant into the heat exchanger(s); and means for splitting the compressed refrigerant stream into vapour and liquid phases and mixing a portion of the vapour phase from the splitting means with a portion of the liquid phase from the splitting means to form the first refrigerant stream that feeds into the heat exchanger, and for mixing the remainder of the vapour phase with the remainder of the liquid phase to form the second refrigerant stream that feeds into the heat exchanger and wherein said splitting of the compressed refrigerant stream occurs prior to said cooling of the compressed refrigerant in the heat exchanger.

8. A refrigeration assembly comprising one or more heat exchangers adapted to receive a product stream to be cooled during use and a refrigerant cycle, said assembly comprising:

a first and a second refrigerant stream flowing through the heat exchanger(s) to provide cooling; wherein the refrigerant in the first refrigerant stream is configured to evaporate at a temperature which is lower than that of the refrigerant in the second refrigerant stream;

a first compressor adapted to receive the first refrigerant stream exiting the heat exchanger(s) and compress the refrigerant to a first level of compression;

a second compressor adapted to receive a mixture of the second refrigerant stream exiting the heat exchanger(s)

and the compressed refrigerant stream from the first compressor and compress the mixture to form a compressed refrigerant stream;

conduits for directing the refrigerant in the compressed refrigerant stream into the heat exchanger(s) to be cooled;

conduits for delivering the cooled refrigerant to an expansion means and then delivering the expanded refrigerant into the heat exchanger(s); and a flash unit for splitting the compressed refrigerant stream into vapour and liquid phases, and conduits for mixing a portion of the vapour phase from the flash unit with a portion of the liquid phase from the flash unit to form the first refrigerant stream that feeds into the heat exchanger, and for mixing the remainder of the vapour phase with the remainder of the liquid phase to form the second refrigerant stream that feeds into the heat exchanger, and wherein said splitting of the compressed refrigerant stream in the flash unit occurs prior to said cooling of the compressed refrigerant in the heat exchanger.

9. The refrigeration process according to claim 1, wherein the product feed stream is natural gas.

10. The refrigeration process according to claim 1, wherein the refrigerant has the following composition:

15-25 mol % methane,
30-45 mol % ethane,
0-20 mol % propane,
0-25 mol % n-butane, and
5-20 mol % nitrogen.

11. The refrigeration process according to claim 1, wherein the product feed stream is cooled to below −30° C.

12. The refrigeration process according to claim 1, wherein the product feed stream is cooled to below −150° C.

13. A process for the liquefaction of natural gas, the process comprising cooling a natural gas feed stream to form liquid natural gas using the process as defined in claim 1.

* * * * *